US009592975B2

(12) United States Patent
Ishikawa

(10) Patent No.: US 9,592,975 B2
(45) Date of Patent: Mar. 14, 2017

(54) PAPER TRANSFER DEVICE

(71) Applicant: RISO KAGAKU CORPORATION, Tokyo (JP)

(72) Inventor: Mitunori Ishikawa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/944,489

(22) Filed: Nov. 18, 2015

(65) Prior Publication Data

US 2016/0152427 A1 Jun. 2, 2016

(30) Foreign Application Priority Data

Nov. 28, 2014 (JP) ..... 2014-240890

(51) Int. Cl.
*B65H 3/44* (2006.01)
*G03G 15/00* (2006.01)
(Continued)

(52) U.S. Cl.
CPC ..... *B65H 3/44* (2013.01); *B65H 5/06* (2013.01); *G03G 15/6511* (2013.01);
(Continued)

(58) Field of Classification Search
CPC . B65H 3/44; B65H 3/446; B65H 3/66; B65H 2405/332; B65H 5/06;
(Continued)

(56) References Cited

U.S. PATENT DOCUMENTS 6,102,386 A * 8/2000 Shigetomi ..... B65H 3/44 271/162
9,139,389 B2 9/2015 Uchino
(Continued)

FOREIGN PATENT DOCUMENTS

JP 04256642 A * 9/1992
JP 06001488 A * 1/1994
JP 2013-199350 A 10/2013

OTHER PUBLICATIONS

U.S. Appl. No. 14/934,748 to Ryohei Etsuki, filed Nov. 6, 2015.

*Primary Examiner* — David H Bollinger
(74) *Attorney, Agent, or Firm* — Greenblum & Bernstein, P.L.C.

(57) ABSTRACT

A paper transfer device includes a first paper transfer path that transfers a paper from a first paper feeder, a second paper transfer path that transfers a paper from a second paper feeder, a first paper guide plate fixed on the first paper transfer path, a rotatable second paper guide plate provided so as to faces the first paper guide plate with the first paper transfer path interposed therebetween when closed, a third paper guide plate fixed on the second paper transfer path, a rotatable fourth paper guide plate provided so as to face the third paper guide plate with the second paper transfer path interposed therebetween when closed, a cooperative mechanism that opens the fourth paper guide plate synchronously with opening of the second paper guide plate, and closes the fourth paper guide plate synchronously with closing of the second paper guide plate.

3 Claims, 17 Drawing Sheets

(51) Int. Cl.
*B65H 5/06* (2006.01)
*G03G 21/16* (2006.01)

(52) U.S. Cl.
CPC ..... *G03G 15/6529* (2013.01); *G03G 21/1638* (2013.01); *G03G 21/1695* (2013.01); *B65H 2601/31* (2013.01); *G03G 2215/00544* (2013.01)

(58) Field of Classification Search
CPC ..... B65H 2601/31; G03G 15/6511; G03G 21/1638; G03G 21/1695; G03G 15/6529; G03G 2215/00544
USPC ..... 271/9.11, 9.13
See application file for complete search history.

(56) References Cited

U.S. PATENT DOCUMENTS

| | | | | |
|---|---|---|---|---|
| 9,272,865 | B2 | 3/2016 | Tsumura et al. | |
| 2010/0078872 | A1* | 4/2010 | Asada | B65H 5/38 271/10.12 |
| 2013/0113157 | A1* | 5/2013 | Fujita | B65H 1/266 271/126 |
| 2013/0249161 | A1* | 9/2013 | Uchino | B65H 3/0684 271/9.01 |

* cited by examiner 32
32a
W
32a1
34
37

32
32e
32f
32b
Z
32f
32g
32h
32d
33
37

32
34

32
Rb 32
32a
32d
32h
32g
32f
Z
32b
36
33
37

32
32c
Rb
VIID
VIIC
VIID
VIIC 32
32a
36
37
32e
32f
32b
33

--PRIOR ART--

PAPER TRANSFER DEVICE

BACKGROUND OF THE INVENTION

Technical Field

The present invention relates to a paper transfer device according to which, when a paper that is selectively fed from first or second paper feeder is jammed during a transfer of the paper to downstream of a paper transfer direction, the jammed paper can be removed easily to an outside of its housing by a simple operation.

Background Arts

Generally, a paper transfer device for transferring papers is adopted in an image forming apparatus, such as a printing apparatus for printing images and characters on papers and a copy machine for copying images and characters on papers.

Such an image forming apparatus is configured to include at least a paper feeder for feeding papers, an image forming unit for forming images on the papers, a paper ejector for ejecting the papers on which images have been printed, and a controller for controlling these components integrally, in its housing.

In the image forming apparatus, a paper jamming may occur due to some reason while transferring a paper from the paper feeder to the image forming unit. A Patent Document 1 (Japanese patent application publication No. 2013-199350) discloses a sheet transfer device (corresponding to a paper transfer device) in which a jammed paper can be removed easily to an outside of its housing.

The sheet transfer device disclosed in the Patent Document 1 will be explained with reference to FIG. 18.

As shown in FIG. 18, in the prior-art sheet transfer device 100 disclosed in the Patent Document 1, a first paper feed tray 101 on which plural papers P are stacked and a second paper feed tray 102 on which plural papers P are stacked are provided at a lower portion of the sheet transfer device 100 so as to be divided as an upper shelf and a lower shelf.

An upper-most paper P among the papers P stacked on the first paper feed tray 101 or an upper-most paper P among the papers P stacked on the second paper feed tray 102 is selectively fed forward by paper feed rollers 103 and 104 that is provided so as to be associated with the first paper feed tray 101 and the second paper feed tray 102, respectively.

A first guide member 105 whose left side face is formed as a first curved portion 105*a* having a convexly curved shape is provided fixedly above the first paper feed tray 101.

A second guide member 106 is provided rotatably about a first axis 107 provided on its lower end side so as to interpose a first transfer path HR1 between the first guide member 105 and the second guide member 106. Cylindrical portions 108 provided on an upper end side of the second guide member 106 can be contacted-with and separated-from concave portions 105*b* formed at an upper portion of the first guide member 105 so as to be deviated in a sheet width direction.

A second curved portion 106*a* having a concavely curved shape is formed an inner side of the second guide member 106 so as to face to the first curved portion 105*a* that has a convexly curved shape and formed on the first guide member 105. A third curved portion 106*b* having a convexly curved shape is formed on an outer side that is an opposite side to the second curved portion 106*a* having a concavely curved shape.

A third guide member 109 is provided rotatably about a second axis 110 provided on its lower end side so as to interpose a second transfer path HR2 between the second guide member 106 and the third guide member 109. Upper end portions 109*a* of the third guide member 109 that are deviated in the sheet width direction can be contacted-with and separated-from the cylindrical portions 108 provided on an upper end side of the second guide member 106.

A fourth curved portion 109*b* having a concavely curved shape is formed an inner side of the third guide member 109 so as to face to the third curved portion 106*b* that has a convexly curved shape and formed on the second guide member 106.

As explained above, behaviors in the case where the guide members 105, 106 and 109 for guiding transfers of the papers P are provided so as to associate with the paper feed tray 101 or 102 will be explained hereinafter.

A paper P fed by the paper feed roller 103 from the first paper feed tray 101 provided as an upper shelf is directed upward through the first transfer path HR1 formed between the first curved portion 105*a* of the first guide member 105 and the second curved portion 106*a* of the second guide member 106, and then fed to a record unit (not shown) via a converging portion 111 provided above the first guide member 105.

On the other hand, a paper P fed by the paper feed roller 104 from the second paper feed tray 102 provided as a lower shelf is directed upward through the second transfer path HR2 formed between the third curved portion 106*b* of the second guide member 106 and the fourth curved portion 109*b* of the third guide member 109, and then fed to the record unit via the converging portion 111.

According to the above configuration, when the second guide member 106 and the third guide member 109 that are rotatable are closed, positions of their upper ends are aligned by the cylindrical portions 108 in the sheet width direction. Therefore, a guide width between the first guide member 105 and the second guide member 106 and a guide width between the second guide member 106 and the third guide member 109 are kept constant.

SUMMARY OF THE INVENTION

However, in the sheet transfer device 100 disclosed in the Patent Document 1, when a paper jam occurs on the first transfer path HR1 or the second transfer path HR2 for some reason, a user or a service person (hereinafter, only the user is referred) opens the second guide member 106 and the third guide member 109 by rotating them in a counter-clockwise direction about the first axis 107 and the second axis 110, respectively, and thereby he/she can remove a jammed paper to an outside of the device 100.

Here, when removing a paper P jammed on the second transfer path HR2 formed between the second guide member 106 and the third guide member 109, the jammed paper can be removed only by a single operation for opening only the third guide member 109.

However, when removing a paper P jammed on the first transfer path HR1 formed between the first guide member 105 and the second guide member 106, it is needed to open the third guide member 109 and then open the second guide member 105. Therefore, the user has to do two operations for opening the third guide member 109 and the second guide member 106, and thereby the operations required for removing the jammed paper are redundant.

In addition, when only the third guide member 109 is opened in a case where a paper jam occurs at an upper area in the first transfer path HR1, a jammed paper may be hidden by the second guide member 106 and thereby the jammed paper may be hard to be found.

An object to the present invention is to provide a paper transfer device according to which, when a paper jam occurs, a jammed paper can be removed easily to an outside of its housing by a simple operation.

An aspect of the present invention provides a paper transfer device comprising: a first paper transfer feeder and a second paper transfer feeder that selectively feed a paper; a first paper transfer path on which the paper fed from the first paper feeder is transferred; a second paper transfer path on which the paper fed from the second paper feeder is transferred; a communal paper transfer path that is disposed download from the first paper transfer path and the second paper transfer path and on which the paper transferred from the first paper transfer path or the second paper transfer path s transferred; a first paper guide plate that is provided fixedly on the first paper transfer path; a second paper guide plate that is provided rotatably so as to be opened and closed, and that, when being closed, faces the first paper guide plate with the first paper transfer path interposed therebetween; a third paper guide plate that is provided fixedly on the second paper transfer path on an inner side from the first paper guide plate; a fourth paper guide plate that is provided rotatably so as to be opened and closed, and that, when being closed, faces the third paper guide plate with the second paper transfer path interposed therebetween and faces the second paper guide plate; and a cooperative mechanism that opens the fourth paper guide plate synchronously with opening of the second paper guide plate, and closes the fourth paper guide plate synchronously with closing of the second paper guide plate.

According to the aspect, if a paper jamming occurs while a paper is transferred along the first paper transfer path or the second paper transfer path toward the communal paper transfer path, the forth paper guide plate is opened by a user's single operation of opening the second paper guide plate via the cooperative member. Therefore, the jammed paper can be removed easily, and it becomes possible to provide the paper transfer device that can bring good operability of removing the jammed paper and can make the number of its parts reduced by simplifying its structure.

In addition, since the forth paper guide plate is opened synchronously with opening of the second paper guide plate, the jammed paper jammed not only on the first paper transfer path but also on the second paper transfer path can be easily found. Namely, a user can easily remove the jammed paper on any of the first paper transfer path and the second paper transfer path.

Further, since an open angle of the second paper guide plate can be made large and thereby the second paper guide plate 32 can be opened widely, the user's hand can be inserted easily when trying to remove the jammed paper.

It is preferable that the cooperative mechanism includes, a cam that formed on the second paper guide plate, a coupling member that is attached to the fourth paper guide plate, and a rotatable linkage member that is pivotally supported by a shaft provided between the second paper guide plate and the fourth paper guide plate, the coupling member is slidably disposed in an elongated hole formed at one end thereof, a cam follower that is contacted-with and separated-from the cam is provided at another end of the linkage member, along with opening of the second paper guide plate, the cam follower is separated from the cam, and thereby the forth paper guide plate is opened via the linkage member; and along with closing of the second paper guide plate, the cam follower is contacted with the cam, and thereby the forth paper guide plate is closed via the linkage member.

In addition, it is preferable that the second paper guide plate includes a pressing portion that is protruded toward the fourth paper guide plate, a curved cam portion and a horizontal cam portion that is formed continuously from the curved cam portion are formed as the cam, the fourth paper guide plate includes a pressed portion that is pressed by the pressing portion of the second paper guide plate, closing of the fourth paper guide plate is temporarily stopped via the linkage member while the cam follower contacts with the horizontal cam portion, but the fourth paper guide plate is fully closed when the pressing portions of the second paper guide plate presses the pressed portion of the fourth paper guide plate.

DESCRIPTION OF THE EMBODIMENT

Hereinafter, a paper transfer device 10 according to an embodiment will be described with reference to FIG. 1 to FIG. 17.

First, an image forming apparatus 1 provided with the paper transfer device 10 will be described with reference to FIG. 1.

Figure 1:
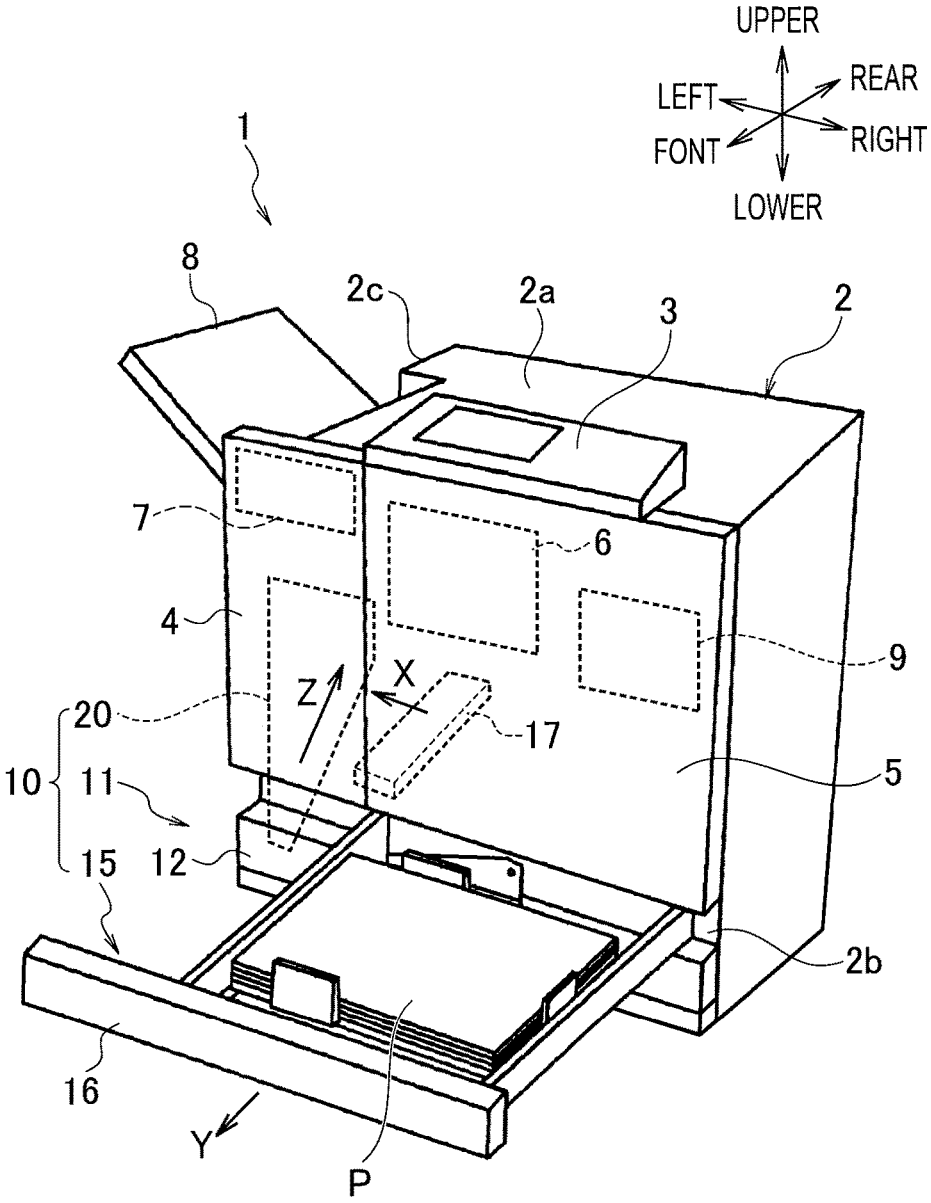
FIG. 1 is a perspective view showing an appearance of an image forming apparatus provided with a paper transfer device according to an embodiment.

As shown in FIG. 1, in the image forming apparatus 1, an operational panel 3 is provided on an upper panel 2*a* of a housing 2 formed to have a box shape. Doors 4 and 5 that can be opened and closed are attached to left and right sides of a front panel 2*b* of the housing 2.

A first paper feeder 11 and a second paper feeder 15 that constitutes a portion of the paper transfer device 10 are provided below the doors 4 and 5 in a double-decker manner so as to be divided as an upper shelf and a lower shelf.

In the first paper feeder 11 as a lower shelf, a first paper feed tray 12 installed at a lower shelf is provided so as to be capable of being draw to a side of the front panel 2*b* of the housing 2 in a direction Y. For example, A3-size papers P are stacked on the first paper feed tray 12.

On the other hand, in the second paper feeder 15 as an upper shelf, a second paper feed tray 16 installed at an upper shelf is provided so as to be stacked over the first paper feed tray 12 and to be capable of being draw to a side of the front panel 2*b* of the housing 2. For example, A4-size papers P are stacked on the second paper feed tray 16.

In addition, a first paper feed mechanism (not shown) to which paper feed rollers Rk1 (FIG. 5A) for feeding papers P are rotatably attached is provided on a front side along a paper feed direction X from the first paper feed tray 12. Similarly, a second paper feed mechanism 17 to which paper feed rollers Rk2 (FIG. 5A) for feeding papers P are rotatably attached is provided on a front side along a paper feed direction X from the second paper feed tray 16.

One of the first paper feed tray 12 and the second paper feed tray 16 is selected to feed an upper-most paper P among the papers stacked on the first paper feed tray 12 or the second paper feed tray 16 in the paper feed direction X.

In addition, on an inner side of the doors 4 and 5 that are attached to left and right sides of the front panel 2*b* of the housing 2 so as to be capable of being opened and closed, an image forming unit 6 that forms imaged on the papers P is provided above the first paper feeder 11 and the second paper feeder 15.

Further, a paper ejection tray 8 that constitutes a paper ejector 7 for ejecting papers P on which images have been formed is provided at an internal upper portion on a side of a left-side panel 2*c* of the housing 2 so as to be protruded outward from the housing 2. A controller 9 that integrally controls the image forming apparatus 1 is provided at an appropriate position in the housing 2.

Furthermore, a paper transfer guide 20 that constitutes the paper transfer device 10 is provided on an inner side of the left-side panel 2*c* of the housing 2. The paper transfer guide 20 transfers a paper P that is selectively fed from the first paper feeder 11 or the second paper feeder 15 to the image forming unit 6 while changing a transfer direction of the paper P upward from the paper feed direction X to a paper transfer direction Z.

Papers P on which images has been formed by printing or copying at the image forming unit 6 are sequentially stacked on the paper ejection tray 8 of the paper ejector 7.

Figure 2:
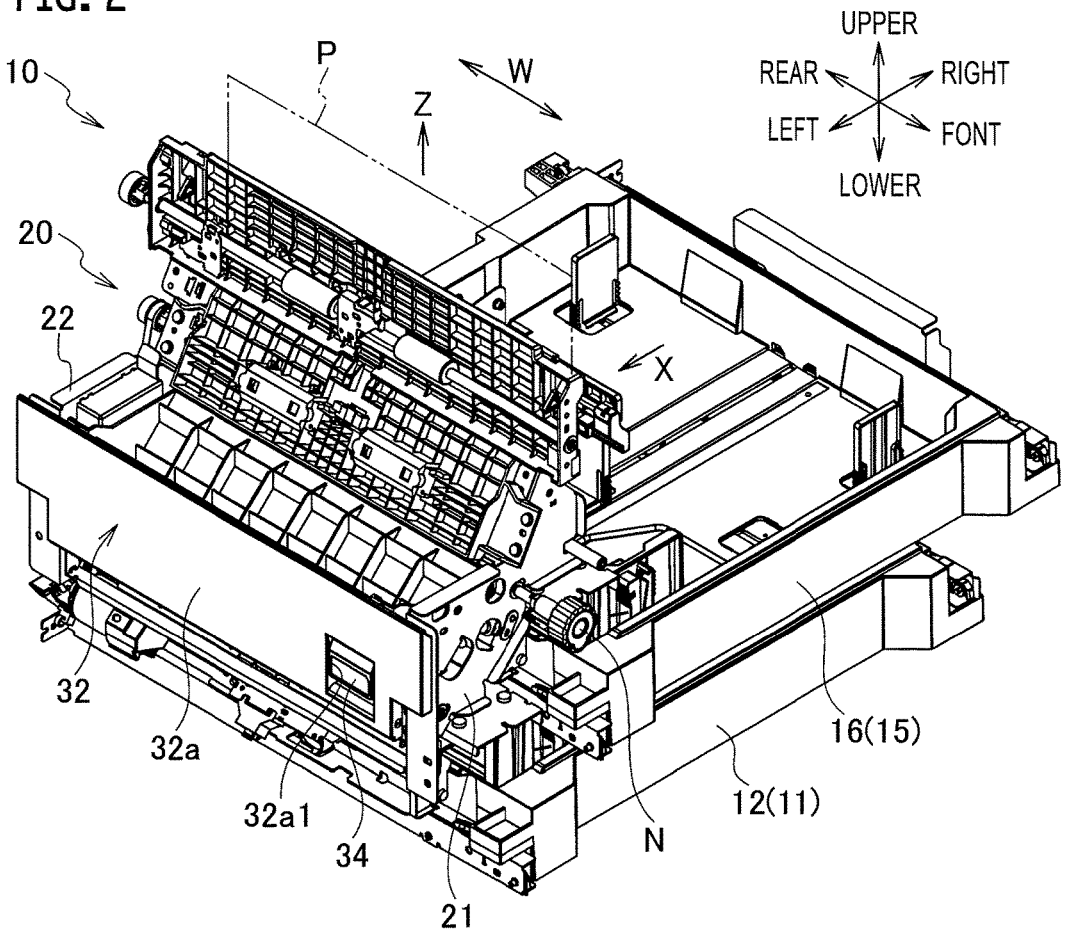
FIG. 2 is a perspective view showing an appearance of the paper transfer device.

As shown in FIG. 2, the paper transfer device 10 includes the first paper feeder 11, the second paper feeder 15 and the paper transfer guide 20.

In case of a paper jam on a first paper transfer path PP1 (FIG. 5A) or a second paper transfer path PP2 (FIG. 5A) in the paper transfer guide 20 while transferring a paper P that is selectively fed from the first paper feeder 11 or the second paper feeder 15 toward the image forming unit 6 (FIG. 1) along the first paper transfer path PP1 or the second paper transfer path PP2, the paper transfer device 10 is improved so as to be able to remove a jammed paper JP (FIG. 4B) easily to an outside of the housing 2 (FIG. 2) by a simple operation.

According to this improvement, the jammed paper JP (FIG. 4B) can be easily removed to an outside of the housing 2, because a second paper guide plate 32 (FIG. 5A) and a fourth paper guide plate 42 (FIG. 5A) that are provided so as to be cooperated with each other by an cooperative mechanism 60 (FIG. 5A) can be opened concurrently by a user's or service person's (hereinafter, only the user is referred) single operation of opening the second paper guide plate 32 that is disposed at a lower portion of the left-side panel 2*c* of the housing 2 (FIG. 1).

Namely, in the paper transfer device 10, the first paper feed tray 12 of the first paper feeder 11 is provided as a lower shelf at a lower portion of the housing 2 (FIG. 1), and the second paper feed tray 16 of the second paper feeder 15 is provided as an upper shelf so as to be stacked over the first paper feed tray 12. In addition, a leading end of the first paper feed tray 12 along the paper feed direction X is protruded leftward from a leading end of the second paper feed tray 16.

Further, the paper transfer guide 20 is disposed between a front-side plate 21 and a rear-side plate 22 that are provided so as to be associated with a front inner side and a rear inner side of the housing 2 (FIG. 1), respectively.

The front-side plate 21 and the rear-side plate 22 are formed from metal sheet materials, and face to each other so as to be distanced from each other in a paper width direction W perpendicular to the paper transfer direction Z. The distance between the front-side plate 21 and the rear-side plate 22 is made wider than a width of papers P.

Figure 3:
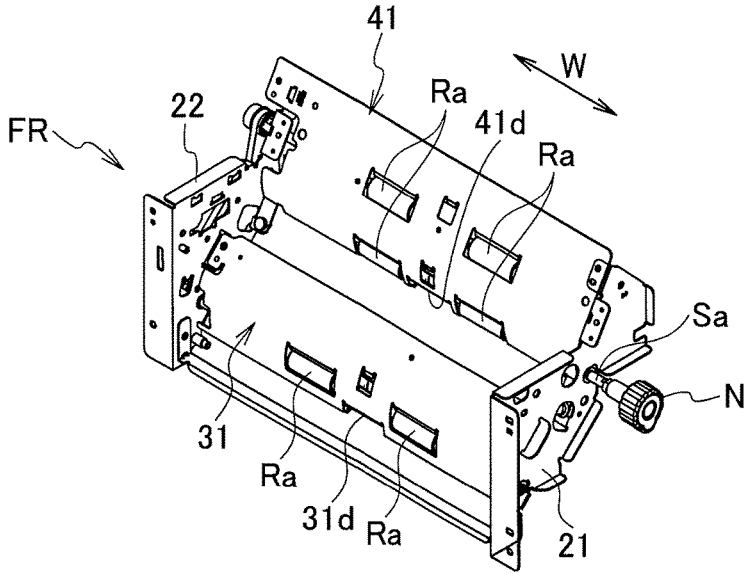
FIG. 3 is a perspective view showing an appearance of a paper transfer guide of the paper transfer device.

Here, as shown in FIG. 3, a first paper guide plate 31 and a third paper guide plate 41 are fixedly disposed between the front-side plate 21 and the rear-side plate 22, and the first paper guide plate 31 and the third paper guide plate 41 are separated at a lower position and an upper position, respectively.

The first paper guide plate 31 and the third paper guide plate 41 is formed from metal sheet materials so as to extend along the paper width direction W, and sets of drive rollers Ra are rotatably provided in them. In each of the sets, plural (e.g. two) drive rollers Ra are fixed to a rotary shaft Sa so as to be distanced from each other along the paper width direction W, and thereby rotatably supported by the rotary shaft Sa.

In addition, a cutout 31*d* is formed at a lower end of the first paper guide plate 31 between the two drive rollers Ra, and is opened downward. Similarly, a cutout 41*d* is formed at a lower end of the third paper guide plate 41 between the two drive rollers Ra, and is opened downward. The cutouts 31*d* and 41*d* are formed in order to remove a jammed paper JP (FIG. 4B) easily as described later.

Further, three rotary shafts Sa to which the drive roller Ra are attached along the paper width direction W are extended between the front-side plate 21 and the rear-side plate 22. One of the rotary shafts Sa is provided laterally in the first paper guide plate 31, other two of the rotary shafts Sa are provided laterally in the third paper guide plate 41. A lower one of the two rotary shafts Sa laterally provided in the third paper guide plate 41 is protruded out from the front-side plate 21, and an operation knob N is fixed with its end.

The rotary shaft Sa to which the operational knob N is fixed is coupled with a reduction gear set (not shown) and a motor (not shown) to drive the drive rollers Ra rotationally, and transmits rotational drive forces to the other two rotary shafts Sa at an outside from the rear-side plate 22 via timing pulleys and timing belts.

When a user rotates only the one rotary shaft Sa manually using the operational knob N, all the rotary shafts Sa are rotated and thereby a jammed paper JP (FIG. 4B) can be easily removed (fed forward or backward manually) by the drive rollers Ra fixed with the rotary shafts Sa.

The first paper guide plate 31 also functions to guide one face of a paper P fed from the first paper feed tray 12 (FIG. 1 and FIG. 2). Similarly, the third paper guide plate 41 also functions to guide one face of a paper P fed from the second paper feed tray 16 (FIG. 1 and FIG. 2).

A frame FR of the paper transfer guide 20 is configured in a state where the first paper guide plate 31 and the third paper guide plate 41 are attached to the frame FR between the front-side plate 21 and the rear-side plate 22.

As shown in FIG. 2, in the paper transfer guide 20, a second paper guide plate 32 provided with a side cover 32*a* is provided rotatably below the left-side panel 2*c* of the housing 2 (FIG. 1). The second paper guide plate 32 faces to the above-described first paper guide plate 31 (FIG. 3), and functions to guide another face of a paper P fed from the first paper feed tray 12.

In addition, an operational lever 34 for opening and closing the second paper guide plate 32 is provided in a rectangular hole 32*a*1 formed on the side cover 32*a* of the second paper guide plate 32.

The operational lever 34 is fixed with a rotational shaft 35 (FIGS. 5A and 5B) to which after-described engagement arms 36 (FIGS. 5A and 5B) are fixed, and thereby the operational lever 34 is rotatable integrally with the engagement arms 36. One of the engagement arms 36 is fixed with one end of the rotational shaft 35, and another of the engagement arms 36 is fixed with another end of the rotational shaft 35. When a user pulls the operational lever 34 to rotate the operational lever 34, the engagement arms 36 are disengaged from the frame FR (FIG. 3).

Figure 4B:
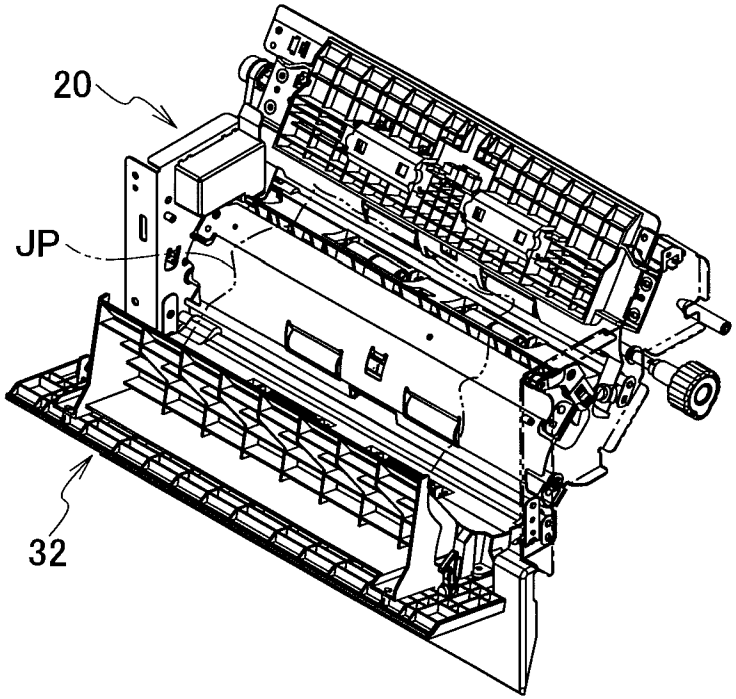
FIG. 4B is a perspective view of the paper transfer guide in its jammed paper removal state.
Figure 4A:
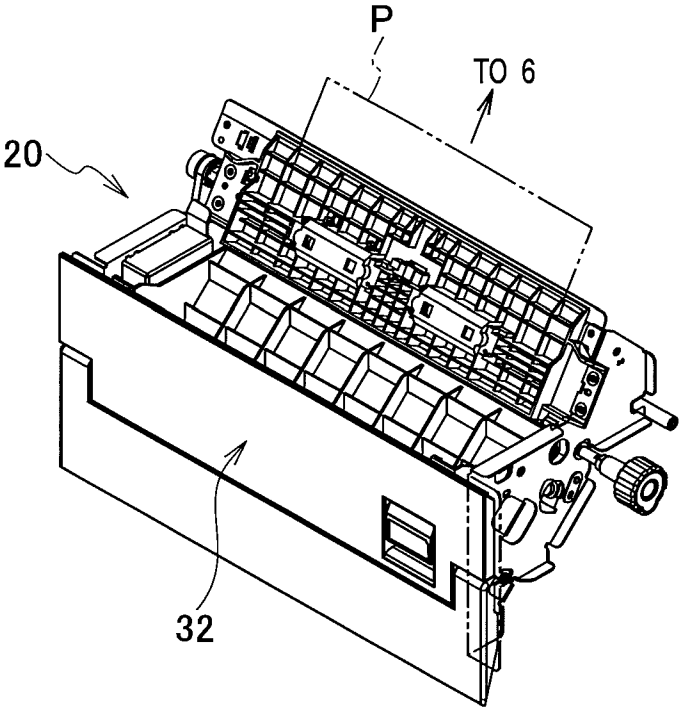
FIG. 4A is a perspective view of the paper transfer guide in its initial state or its paper transfer state.

As shown in FIG. 4A, when the second paper guide plate 32 is closed, the paper transfer guide 20 is in its initial state or its paper transfer state.

When the second paper guide plate 32 is in the initial state, no paper P is fed from the first paper feeder 11 or the second paper feeder 15. On the other hand, when the second paper guide plate 32 is in the paper transfer state, a paper P selectively fed from the first paper feeder 11 or the second paper feeder 15 is transferred toward the image forming unit 6 (FIG. 1).

In addition, as shown in FIG. 4B, since an inside of the paper transfer guide 20 is widely exposed when the second paper guide plate 32 is opened by a user, the user can easily remove a jammed paper JP jammed on the paper transfer path PP1 or PP2.

<Paper Transfer guide 20>

The paper transfer guide 20 will be described with reference to FIG. 5A to FIG. 5C.

Figure 5A:
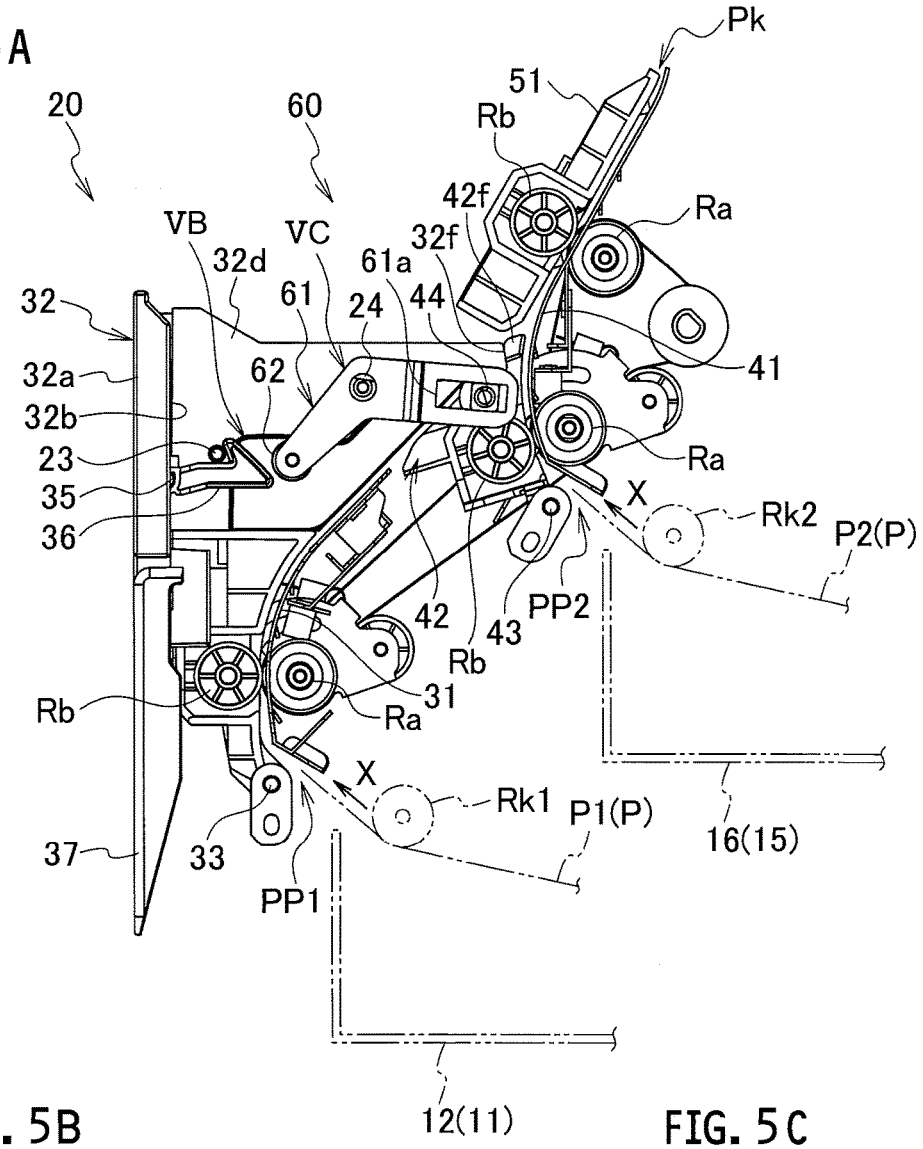
FIG. 5A is a side view of the paper transfer guide.
Figure 5B:
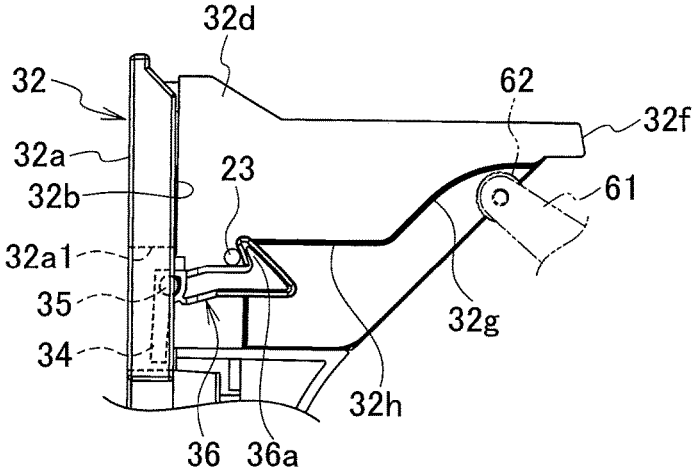
FIG. 5B is an enlarged side view showing a portion VB indicated in FIG. 5A.

FIG. 5A and FIG. 5B shows the initial state or the paper transfer state. Note that the front-side plate 21 of the frame FR shown in FIG. 3 is not shown in FIG. 5A.

Figure 11:
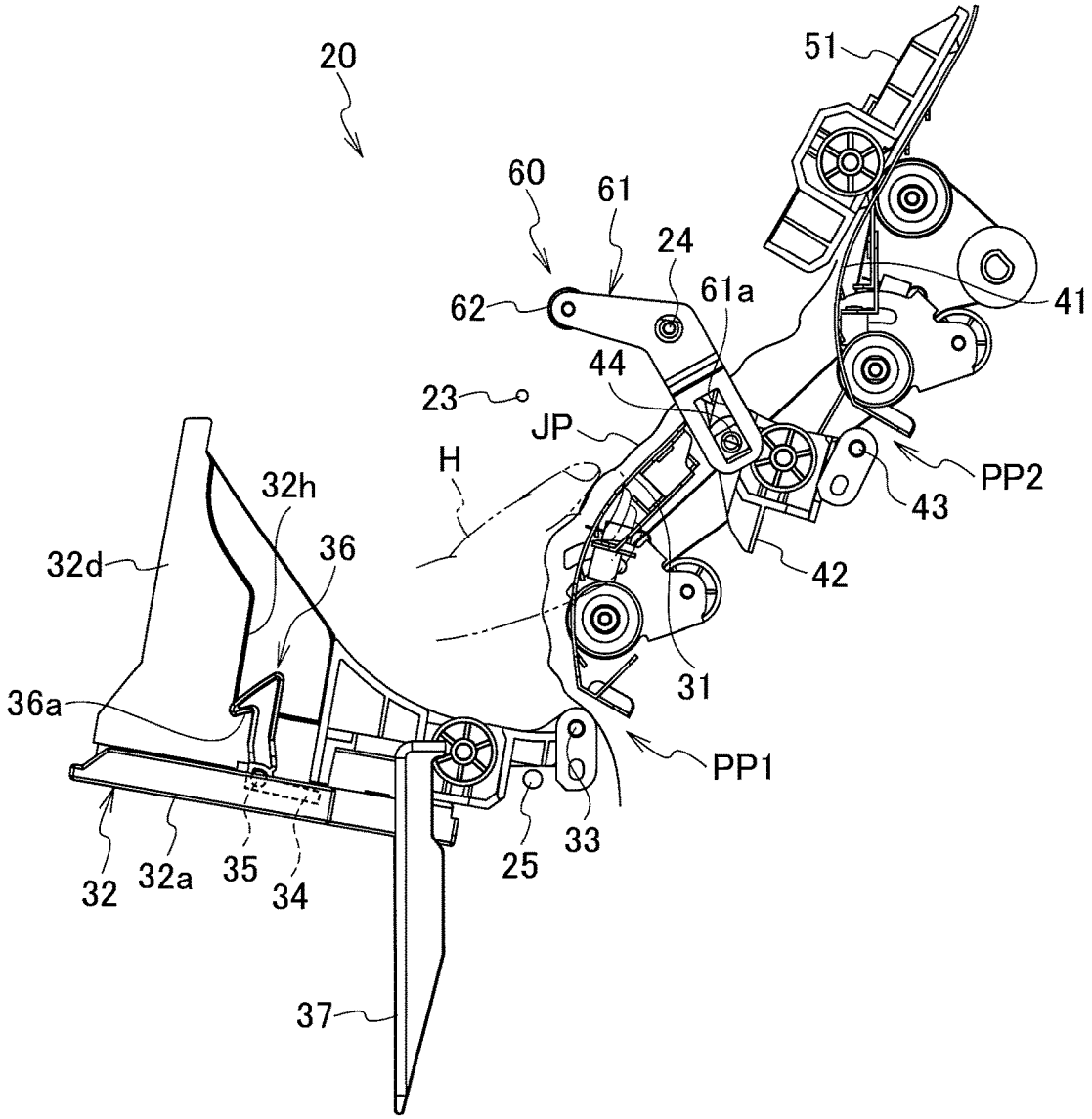
FIG. 11 is a side view showing a first operated state of the paper transfer guide.

As shown in FIG. 5A, the first paper guide plate 31 and the second paper guide plate 32 are provided on a downstream side along the paper feed direction X from the first paper feed tray 12 of the first paper feeder 11 provided as a lower shelf. The first paper guide plate 31 is fixedly provided on the frame FR (FIG. 3) along the first paper transfer path PP1. The second paper guide plate 32 is provided rotatably about a first rotational axis 33, and can be opened and closed by a user's hand H (FIG. 11). The second paper guide plate 32 faces to the first paper guide plate 31 with the first paper transfer path PP1 interposed therebetween.

On the other hand, the third paper guide plate 41 and the fourth paper guide plate 42 are provided on a downstream side along the paper feed direction X from the second paper feed tray 16 of the second paper feeder 15 provided as an upper shelf. The third paper guide plate 41 is fixedly provided on the frame FR (FIG. 3) along the second paper transfer path PP2 that is provided on an inner side from the first paper feed path PP1. The fourth paper guide plate 42 is provided rotatably about a second rotational axis 43. The fourth paper guide plate 42 faces to an upstream portion of the third paper guide plate 41 with the second paper transfer path PP2 interposed therebetween, and also faces to the second paper guide plate 32.

The cooperative mechanism 60 that opens/closes the fourth paper guide plate 42 in conjunction with an opening/closing operation of the second paper guide plate 32. The cooperative mechanism 60 is a member that constitutes a main portion of the present embodiment, and will be described later in detail.

Further, a communal paper guide plate 51 is provided on a down streamside from the third paper guide plate 41 and the fourth paper guide plate 42, and faces a downstream portion of the third paper guide plate 41 with a communal paper transfer path Pk interposed therebetween.

In the initial state and the paper transfer state of the paper transfer guide 20, a gap of the first paper transfer path PP1 formed between the first paper guide plate 31 and the second paper guide plate 32 that face to each other is set to a predetermined value. Similarly, in the initial state and the paper transfer state of the paper transfer guide 20, a gap of the second paper transfer path PP2 formed between the third paper guide plate 41 and the fourth paper guide plate 42 that face to each other is set to a predetermined value.

In addition, while the second paper guide plate 32 is closed by being rotated about the first rotational axis 33 in a clockwise direction, driven rollers Rb rotatably attached to the second paper guide plate 32 are pressed onto the drive rollers Ra rotatably attached to the first paper guide plate 31 by an urging force of a spring (not shown).

On the other hand, while the second paper guide plate 32 is closed, driven rollers Rb rotatably attached to the fourth paper guide plate 42 are also pressed onto the drive rollers Ra rotatably attached to the third paper guide plate 41 by an urging force of a spring (not shown).

Further, driven rollers Rb rotatably attached to the communal paper guide plate 51 are also pressed onto the drive rollers Ra rotatably attached to the third paper guide plate 41 by an urging force of a spring (not shown).

A paper P1 (P) fed by the paper feed rollers Rid from the first paper feed tray 12 provided as a lower shelf is fed along the first paper transfer path PP1 formed between the first paper guide plate 31 and the second paper guide plate 32 toward the communal paper transfer path Pk, and then sent to the image forming unit 6 (FIG. 1).

On the other hand, a paper P2 (P) fed by the paper feed rollers Rk2 from the second paper feed tray 16 provided as an upper shelf is fed along the first paper transfer path PP1 formed between the first paper guide plate 31 and the second paper guide plate 32 toward the communal paper transfer path Pk, and then sent to the image forming unit 6 (FIG. 1).

Therefore, a paper P1 from the first paper feed tray 12 or a paper P2 from the second paper feed tray 16 passes through the communal paper transfer path Pk, selectively.

Figure 5C:
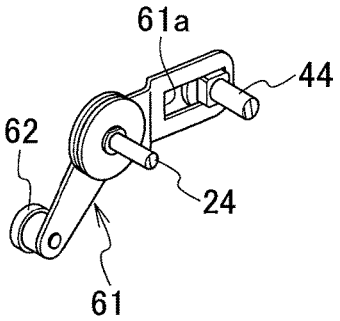
FIG. 5C is an enlarged perspective view showing a portion VC indicated in FIG. 5A.

As shown in FIG. 5A to FIG. 5C, the cooperative mechanism 60 includes a cam (32*g*+32*h*) formed on the second paper guide plate 32, a coupling member (movable block) 44 attached to the fourth paper guide plate 42, and a linkage member 61. The linkage member 61 is pivotally supported by a shaft 24 that is provided between the second paper guide plate 32 and the fourth paper guide plate 42, and thereby can be rotate. The coupling member 44 is slidably disposed in an elongated hole (rectangular hole) 61*a* formed at one end of the linkage member 61, and can slide in a longitudinal direction of the elongated hole 61*a*. A cam follower 62 that is contacted-with and separated-from the cam (32*g*+32*h*) is provided at another end of the linkage member 61.

Specifically, the cooperative mechanism 60 is configured to operate the rotatable second paper guide plate 32 and the rotatable fourth paper guide plate 42 together with other via the linkage member 61.

As shown in FIG. 5C, the linkage member 61 is formed to have an angled arm shape, and pivotally supported by the shaft 24 that is attached to an inner surface of the front-side plate 21 (FIG. 5).

The coupling member 44 is the movable block 44 having a cubic shape in the present embodiment, but may be a coupling pin instead of the movable block 44. Hereinafter, the coupling member 44 is referred as the movable block 44.

A length of one side of the above-described cubic movable block 44 is associated with a length of a short side of the rectangular hole 61*a*. The cubic movable block 44 includes a shaft that is integrally fixed therewith so as to passes through its center. The shaft is attached to a side plate 42*d* (FIG. 9C) of the fourth paper guide plate 42.

As shown in FIG. 5B, the cam follower 62 attached to the other end of the linkage member 61 rotates so as to be contacted-with and separated-from a curved cam portion 32*g* and a horizontal cam portion 32*h*. The curved cam portion 32*g* is formed at an upper portion of an inner side plate 32*d* of the second paper guide plate 32. The horizontal cam portion 32*h* extends continuously from a lower end of the curved cam portion 32*g*.

Note that, since the abovementioned inner side plate 32*d* and an inner side plate 32*e* (FIG. 7B) on an opposite side to the inner side plate 32*d* of the second paper guide plate 32 located on an inner side from outermost ends of the side cover 32*a* of the second paper guide plate 32 along the paper width direction W, they are referred as the "inner" side plates 32*d* and 32*e*, hereinafter.

Therefore, as explained later in detail (FIG. 12), the cam follower 62 moves along the curved cam portion 32*g* of the second paper guide plate 32 along with a user's closing operation of the second paper guide plate 32, and thereby the linkage member 61 is rotated. According to the rotation of the linkage member 61, the fourth paper guide plate 42 is rotated due to coupling of the movable block 44 with the rectangular hole 61*a*. Discordancy between a rotating path of the linkage member 61 and a rotating path of the fourth paper guide plate 42 can be absorbed by a movement of the movable block 44 in the rectangular hole 61*a*.

Therefore, the second paper guide plate 32 and the fourth paper guide plate 42 can be smoothly operated together with each other only by the linkage member 61 without using plural linkage members.

In addition, pressing portions 32*f* that are protruded toward the fourth paper guide plate 42 are formed on the second paper guide plate 32. Associated with the pressing portions 32*f*, pressed portions 42*f* that are protruded toward the second paper guide plate 32 are formed on the fourth paper guide plate 42. Behaviors of the pressing portions 32*f* for pressing the pressed portions 42*f* will be described later in detail.

In addition, the rotational shaft 35 extended in the paper width direction W is attached to a rear surface of the side cover 32*a* of the second paper guide plate 32.

As shown in FIG. 5B, one of the engagement arms 36 is fixed at one end of the rotational shaft 35 on a side of the front-side plate 21. Similarly, another of the engagement arms 36 is fixed at another end of the rotational shaft 35 on a side of the rear-side plate 22. The two engagement arms 36 are rotatable integrally with the rotational shaft 35. A hook 36*a* of the engagement arm 36 is engaged with an engagement pin 23 protruded from an inner surface of the front-side plate 21 (the rear-side plate 22), and the hook 36*a* can be disengaged when the rotational shaft 35 is rotated by the operational lever 34.

In addition, as already described, the operational lever 34 exposed from the rectangular hole 32*a*1 formed on the side cover 32*a* of the second paper guide plate 32 is fixed to the rotational shaft 35.

The plural paper guide plates of the paper transfer guide 20 will be described in detail with reference to FIG. 6A to FIG. 10F.

<First Paper Guide Plate 31>

The first paper guide plate 31 is shown in FIG. 6A to FIG. 6F. The first paper guide plate 31 is fixed with lower portions of the front-side plate 21 and the rear-side plate 22 shown in FIG. 3. The first paper guide plate 31 functions to guide one surface of a paper P1 from the first paper feed tray 12 (FIG. 5A) provided as a lower shelf.

The first paper guide plate 31 is formed from metal sheet materials to have a long shape along the paper width direction W. Its front face 31*a* that guides a paper P1 is formed to have a convex shape that curved along the paper transfer direction Z.

In the first paper guide plate 31, two rectangular holes 31*c* are formed from its rear face 31*b* to its front face 31*a*. The two rectangular holes 31*c* are aligned in a single axial line along the paper width direction W. The drive rollers Ra (FIG. 3) are exposed from the rectangular holes 31*c*.

The first paper guide plate 31 includes the cutout 31*d* opened downward between the two rectangular holes 31*c*. The cutout 31*d* is formed in order to pickup a jammed paper JP (FIG. 4B) easily by hand. In addition, a jammed paper JP jammed on the second paper transfer path PP2 (FIG. 5A) can be viewed easily through the cutout 31*d*.

<Second Paper Guide Plate 32>

The second paper guide plate 32 is shown in FIG. 7A to FIG. 7G. The second paper guide plate 32 is supported rotatably about the first rotational axis 33 provided at its lower portion so as to face the first paper guide plate 31. The second paper guide plate 32 functions to guide another surface of the paper P1 from the first paper feed tray 12 (FIG. 5A) provided as a lower shelf.

The second paper guide plate 32 is formed from high-stiffness resign material to have a long shape along the paper width direction W, and the side cover 32*a* of the second paper guide plate 32 is made flat as an exterior facing.

In addition, a rear surface 32*b* of the second paper guide plate 32 that guides the paper P1 is formed to have a concave shape that is curved along the paper transfer direction Z so that the concave shape of the rear surface 32*b* corresponds with the convex shape of the front face 31*a* (FIG. 6A) of the first paper guide plate 31.

In the second paper guide plate 32, two rectangular holes 32*c* are formed as bottomed holes. The two rectangular holes 32*c* are aligned in a single axial line along the paper width direction W. The driven rollers Rb are exposed from the rectangular holes 32*c*.

Note that a lower side cover 37 is provided below the side cover 32*a* of the second paper guide plate 32 so as to be suspended from the side cover 32*a*.

Figures 7A, 7B, 7C, 7D, 7E, 7F, 7G:
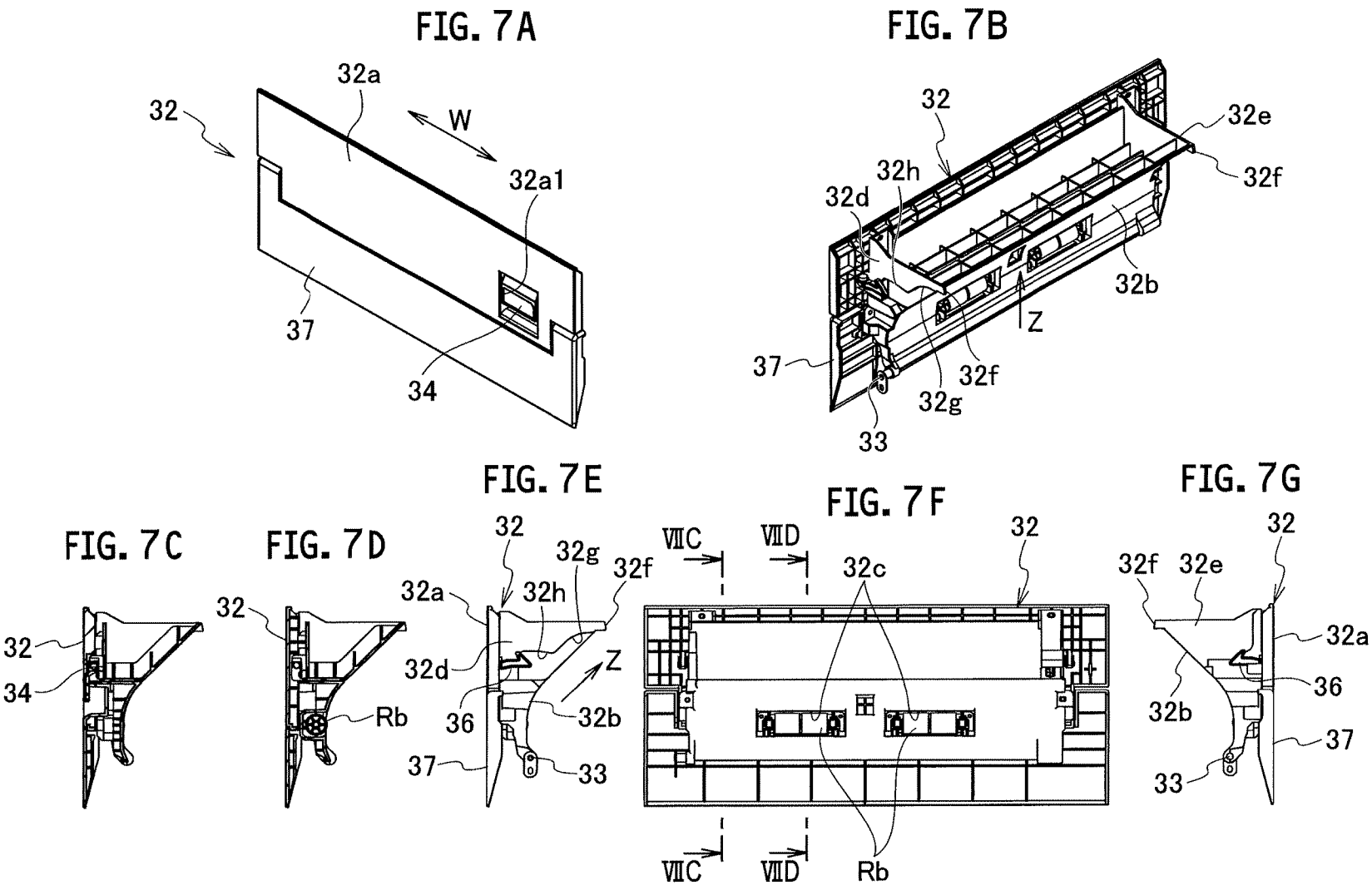
FIG. 7A is a perspective view showing a front side of a second paper guide plate of the paper transfer guide.
FIG. 7B is a perspective view showing a rear side of the second paper guide plate.
FIG. 7C is a cross-sectional view of the second paper guide plate taken along a line VIIC-VIIC indicated in FIG. 7F.
FIG. 7D is another cross-sectional view of the second paper guide plate taken along a line VIID-VIID indicated in FIG. 7F.
FIG. 7E is a side view of the second paper guide plate.
FIG. 7F is a rear view of the second paper guide plate.
FIG. 7G is another side view of the second paper guide plate.
Figure 8A:
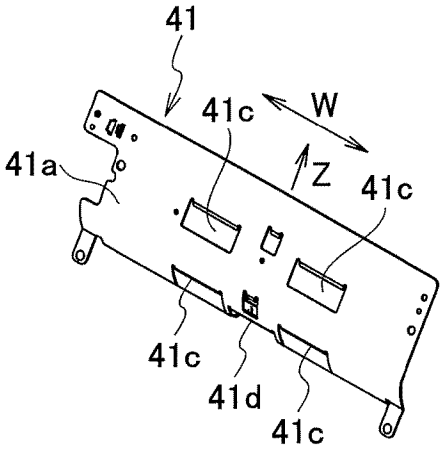
FIG. 8A is a perspective view showing a front side of a third paper guide plate of the paper transfer guide.
Figure 8B:
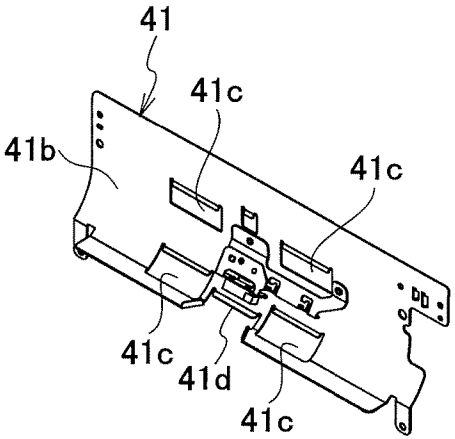
FIG. 8B is a perspective view showing a rear side of the third paper guide plate.
Figure 8C:
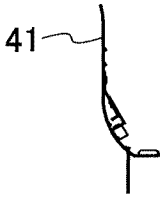
FIG. 8C is a side view of the third paper guide plate.
Figure 8D:
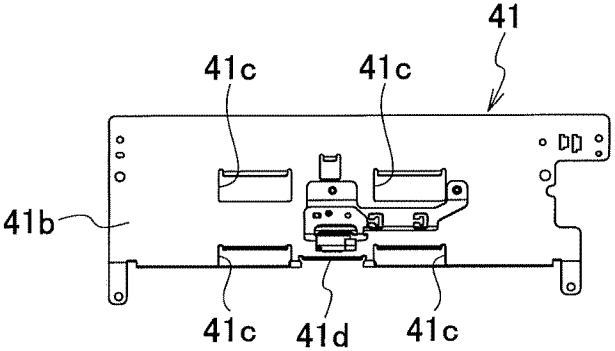
FIG. 8D is a rear view of the third paper guide plate.
Figure 8E:
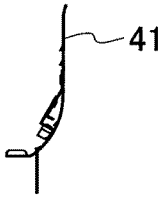
FIG. 8E is another side view of the third paper guide plate.

As shown in FIG. 7A, FIG. 7C and FIG. 7F, the above-described operational lever 34 is provided in the rectangular hole 32*a*1 formed on the side cover 32*a* of the second paper guide plate 32. The operational lever 34 is rotatable integrally with the two engagement arms 36 shown in FIG. 7E and FIG. 7G.

In addition, as shown in FIG. 7B, FIG. 7E and FIG. 7G, the pressing portions 32*f* are formed at upper end portions of the inner side plates 32*d* and 32*e* of the second paper guide plate 32. The pressing portions 32*f* can be contacted-with and separated-from the pressed portions 42*f* (FIG. 9C, FIG. 9D and FIG. 9G) formed on the fourth paper guide plate 42.

Further, as shown in FIG. 7B and FIG. 7E, the curved cam portion 32*g* and the horizontal cam portion 32*h* are formed continuously from each other below the pressing portion 32*f* formed at the upper end portion of the inner side plate 32*d* in the second paper guide plate 32. No cam portion is formed on the other inner side plate 32*e* facing to the inner side plate 32*d* so as to be distanced from the inner side plate 32*d* in the paper width direction W.

<Third Paper Guide Plate 41>

The third paper guide plate 41 is shown in FIG. 8A to FIG. 8E. The third paper guide plate 41 is fixed with upper portions of the front-side plate 21 and the rear-side plate 22 shown in FIG. 3. The third paper guide plate 41 functions to guide one surface of a paper P2 from the second paper feed tray 16 (FIG. 5A) provided as an upper shelf.

The third paper guide plate 41 is formed from metal sheet materials to have a long shape along the paper width direction W. Its front face 41*a* that guides a paper P2 is formed to have a convex shape that curved along the paper transfer direction Z.

In the third paper guide plate 41, four rectangular holes 41*c* are formed from its rear face 41*b* to its front face 41*a*. Two of the rectangular holes 41*c* are aligned in a single upper axial line along the paper width direction W. Remaining two of the rectangular holes 41*c* are aligned in a single lower axial line along the paper width direction W. The drive rollers Ra (FIG. 3) are exposed from the rectangular holes 41*c*.

The third paper guide plate 41 includes the cutout 41*d* opened downward between the lower two rectangular holes 41*c*. The cutout 41*d* is formed in order to pickup a jammed paper JP (FIG. 4B) easily by hand.

<Fourth Paper Guide Plate 42>

The fourth paper guide plate 42 is shown in FIG. 9A to FIG. 9G. The fourth paper guide plate 42 is supported rotatably about the second rotational axis 43 provided at its lower portion so as to face an upstream portion of the third paper guide plate 41. The fourth paper guide plate 42 functions to guide another surface of the paper P2 from the second paper feed tray 16 (FIG. 5A) provided as an upper shelf.

Figure 9A:
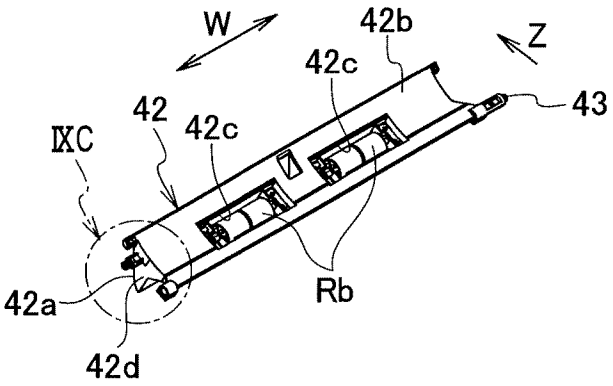
FIG. 9A is a perspective view showing a rear side of a fourth paper guide plate of the paper transfer guide when the fourth paper guide plate is viewed from one side.
Figure 9B:
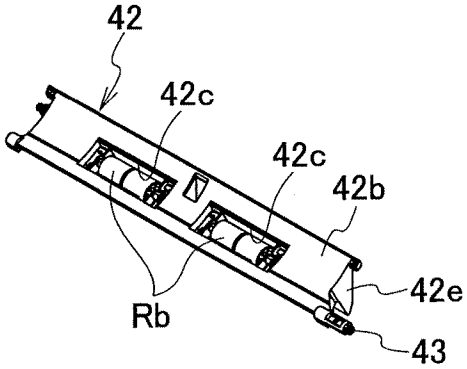
FIG. 9B is another perspective view showing the rear side of the fourth paper guide plate when the fourth paper guide plate is viewed from another side.
Figure 9C:
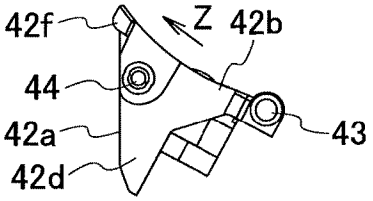
FIG. 9C is an enlarged side view showing a portion IXC indicated in FIG. 9A.

The fourth paper guide plate 42 is formed from high-stiffness resign material to have a long shape along the paper width direction W. As shown in FIG. 9C, its front surface 42*a* is made smooth so as to accept a contact of the paper P1 from the first paper feed tray 12 (FIG. 5A) provided as a lower shelf. In addition, its rear surface 42*b* that guides the paper P2 is formed to have a concave shape that is curved along the paper transfer direction Z so that the concave shape of the rear surface 42*b* corresponds with the convex shape of the front face 41*a* (FIG. 8A) of the third paper guide plate 41.

In the fourth paper guide plate 42, two rectangular holes 42*c* are formed as bottomed holes. The two rectangular holes 42*c* are aligned in a single axial line along the paper width direction W. The driven rollers Rb are exposed from the rectangular holes 42*c*.

In addition, as shown in FIG. 9C, the shaft of the movable block 44 that is coupled with the linkage member 61 (FIG. 5A) is attached to a side plate 42*d* of the fourth paper guide plate 42. The shaft of the movable block 44 is protruded laterally outward.

Therefore, the side plate 42*d* is provided with two axes, e.g. the second rotational axis 43 that is located at its lower portion, and the shaft of the movable block 44 located that is located at its upper portion.

Figure 9D:
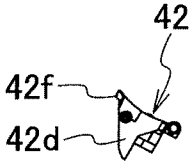
FIG. 9D is a side view of the fourth paper guide plate.
Figure 9E:
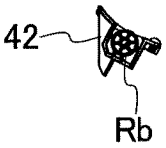
FIG. 9E is a cross-sectional view of the fourth paper guide plate taken along a line IXE-IXE indicated in FIG. 9F.
Figure 9F:
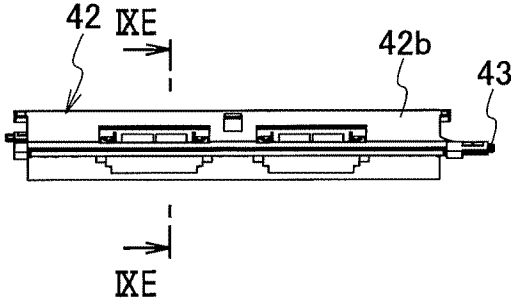
FIG. 9F is a rear view of the fourth paper guide plate.
Figure 9G:
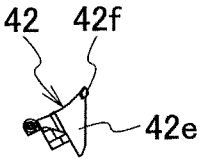
FIG. 9G is another side view of the fourth paper guide plate.
Figure 10A:
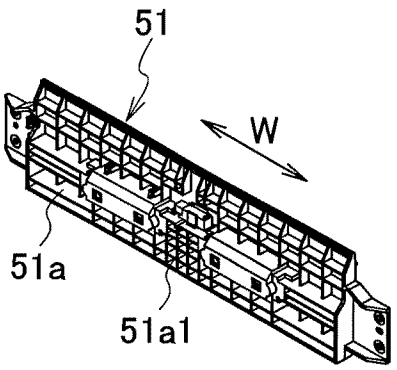
FIG. 10A is a perspective view showing a front side of a communal paper guide plate of the paper transfer guide.
Figure 10B:
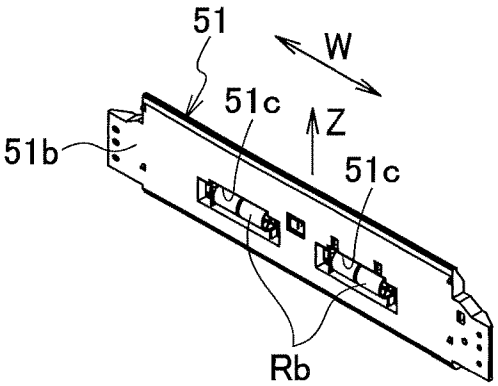
FIG. 10B is a perspective view showing a rear side of the communal paper guide plate.
Figure 10C:
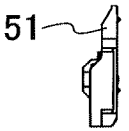
FIG. 10C is a side view of the communal paper guide plate.
Figure 10D:
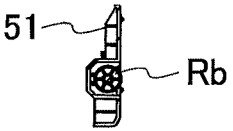
FIG. 10D is a cross-sectional view of the communal paper guide plate taken along a line XD-XD indicated in FIG. 10E.
Figure 10E:
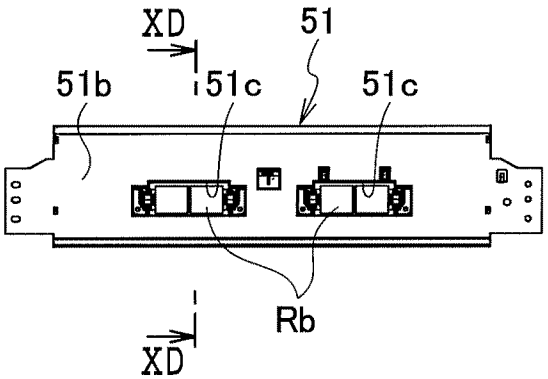
FIG. 10E is a rear view of the communal paper guide plate.
Figure 10F:
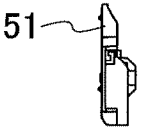
FIG. 10F is another side view of the communal paper guide plate.

Further, as shown in FIG. 9C, FIG. 9D and FIG. 9G, the pressed portions 42*f* are formed at upper end portions of the side plates 42*d* and 42*e* of the fourth paper guide plate 42. As described above, the pressed portions 42*f* can be contacted-with and separated-from the pressing portions 32*f* (FIG. 7B and FIG. 7E) formed at upper end portions of the inner side plates 32*d* and 32*e* of the second paper guide plate 32.

<Communal Paper Guide Plate 51>

The communal paper guide plate 51 is shown in FIG. 10A to FIG. 10F. The communal paper guide plate 51 is provided fixedly so as to face a downstream portion of the third paper guide plate 41. The communal paper guide plate 51 functions to guide the other surface of the paper P1 from the first paper feed tray 12 (FIG. 5A) or the paper P2 from the second paper feed tray 16 (FIG. 5A).

The communal paper guide plate 51 is formed from high-stiffness resign material to have a long shape along the paper width direction W. Plural reinforcing ribs 51*a*1 are formed vertically and horizontally on its front surface 51*a*. Its rear surface 51*b* that guides the paper P1 or P2 is made flat along so as to be almost straight along the paper transfer direction Z.

In the communal paper guide plate 51, two rectangular holes 51*c* are formed as bottomed holes. The two rectangular holes 51*c* are aligned in a single axial line along the paper width direction W. The driven rollers Rb are exposed from the rectangular holes 32*c*.

Next, operated states of the paper transfer guide 20 configured as described above will be described with reference to FIG. 11 to FIG. 16.

<Operated States of Paper Transfer Guide 20>

FIG. 11 to FIG. 16 show a first operated state to a sixth operated state of the paper transfer guide 20. Note that the second paper feed tray 16 is not shown in FIG. 11 to FIG. 16, and the front-side plate 21 of the frame FR shown in FIG. 3 is not shown in FIG. 11 to FIG. 16.

Here, as already described with reference to FIG. 5A, while transferring a paper P1 fed from the first paper feed tray 12 provided as a lower shelf along the first paper transfer path PP1 and the communal paper transfer path Pk to the image forming unit 6 (FIG. 1) or while transferring a paper P2 fed from the second paper feed tray 16 provided as an upper shelf along the second paper transfer path PP2 and the communal paper transfer path Pk to the image forming unit 6 (FIG. 1), a transferring state of the paper P1 or P2 is monitored by an optical sensor (not shown) provided in the paper transfer device 10 by the controller 9 (FIG. 1).

If time taken until the paper P1 or P2 is transferred to a monitoring position of the optical sensor exceeds predetermined paper transfer time, the controller 9 determines that a paper jamming occurs and then outputs a warning to a user.

When the user receives the waring, the user removes a jammed paper JP (FIG. 4B) out from the paper transfer device 10 by jammed paper removal operations in which the first operated state to the sixth operated state shown in FIG. 11 to FIG. 16 are sequentially done.

First, in the first operated state shown in FIG. 11, the second paper guide plate 32 is opened, and thereby the jammed paper JP is about to be removed by a user's hand H.

Namely, as shown in FIG. 11, when the user pulls the operational lever 34 attached to the side cover 32*a* of the second paper guide plate 32 to rotate the engagement arms 36 together with the rotational shaft 35, the hooks 36*a* of the engagement arms 36 are disengaged from the engagement pins 23 provided on the inner surfaces of the front-side plate 21 and the rear-side plate 22 (FIG. 3).

Due to the disengagements of the engagement arms 36 from the engagement pins 23, the second paper guide plate 32 is rotated about the first rotational axis 33 in a counter-clockwise direction by its own weight, and thereby is opened downward. An open position of the second paper guide plate 32 is restricted by stoppers 25 provided on the front-side plate 21 and the rear-side plate 22 (FIG. 3).

In addition, along with opening of the second paper guide plate 32, the cam follower 62 attached to the linkage member 61 of the cooperative mechanism 60 is separated from the cam (the curved cam portion 32*g*) formed on the inner side plate 32*d* of the second paper guide plate 32.

Therefore, an open angle of the second paper guide plate 32 can be made large, and thereby the second paper guide plate 32 can be opened widely. As a result, the hand H can be inserted easily when trying to remove the jammed paper JP.

In addition, along with separating of the linkage member 61 from the second paper guide plate 32, the fourth paper guide plate 42 that is linked with the linkage member 61 via the movable block 44 slidably held in the rectangular hole 61*a* is rotated about the second rotational axis 43 in a counter-clockwise direction by its own weight, and thereby is opened. An open position of the fourth paper guide plate 42 is restricted by the movable block 44 and the rectangular hole 61*a*. When the fourth paper guide plate 42 is fully opened, the movable block 44 is located at one end (a lower right end in FIG. 11) of the rectangular hole 61*a*.

As the result, both of the first paper transfer path PP1 formed between the first paper guide plate 31 and the second paper guide plate 32 and the second paper transfer path PP2 formed between the third paper guide plate 41 and the fourth paper guide plate 42 are exposed, and thereby the jammed paper JP jammed on the first paper transfer path PP1 or the second paper transfer path PP2 can be removed easily by the hand H. Namely, it becomes possible to provide the paper transfer device 10 that can bring good operability of removing the jammed paper JP and can make the number of its parts reduced by simplifying its structure.

Figure 6A:
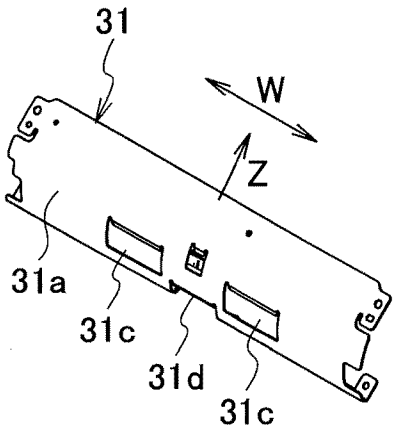
FIG. 6A is a perspective view showing a front side of a first paper guide plate of the paper transfer guide.
Figure 6B:
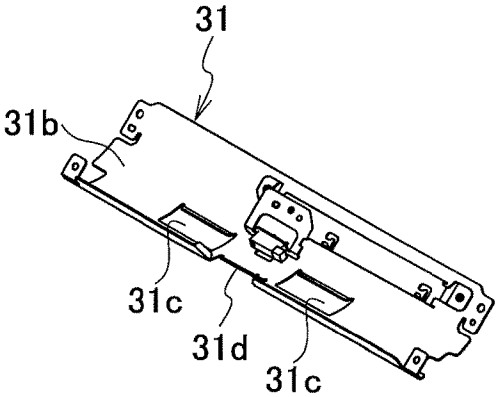
FIG. 6B is a perspective view showing a rear side of the first paper guide plate.
Figure 6C:
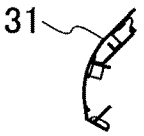
FIG. 6C is a side view of the first paper guide plate.
Figure 6D:
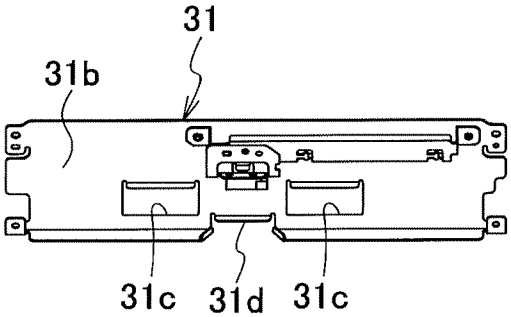
FIG. 6D is a rear view of the first paper guide plate.
Figure 6E:
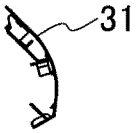
FIG. 6E is another side view of the first paper guide plate.

In addition, since the fourth paper guide plate 42 is opened synchronously with the opening operation of the second paper guide plate 32, the jammed paper JP jammed not only on the first paper transfer path PP1 but also on the second paper transfer path PP2 can be easily found through the cutout 31*d* (FIG. 3 and FIG. 6D). Namely, the user can easily remove the jammed paper JP on any of the first paper transfer path PP1 and the second paper transfer path PP2.

Figure 12:
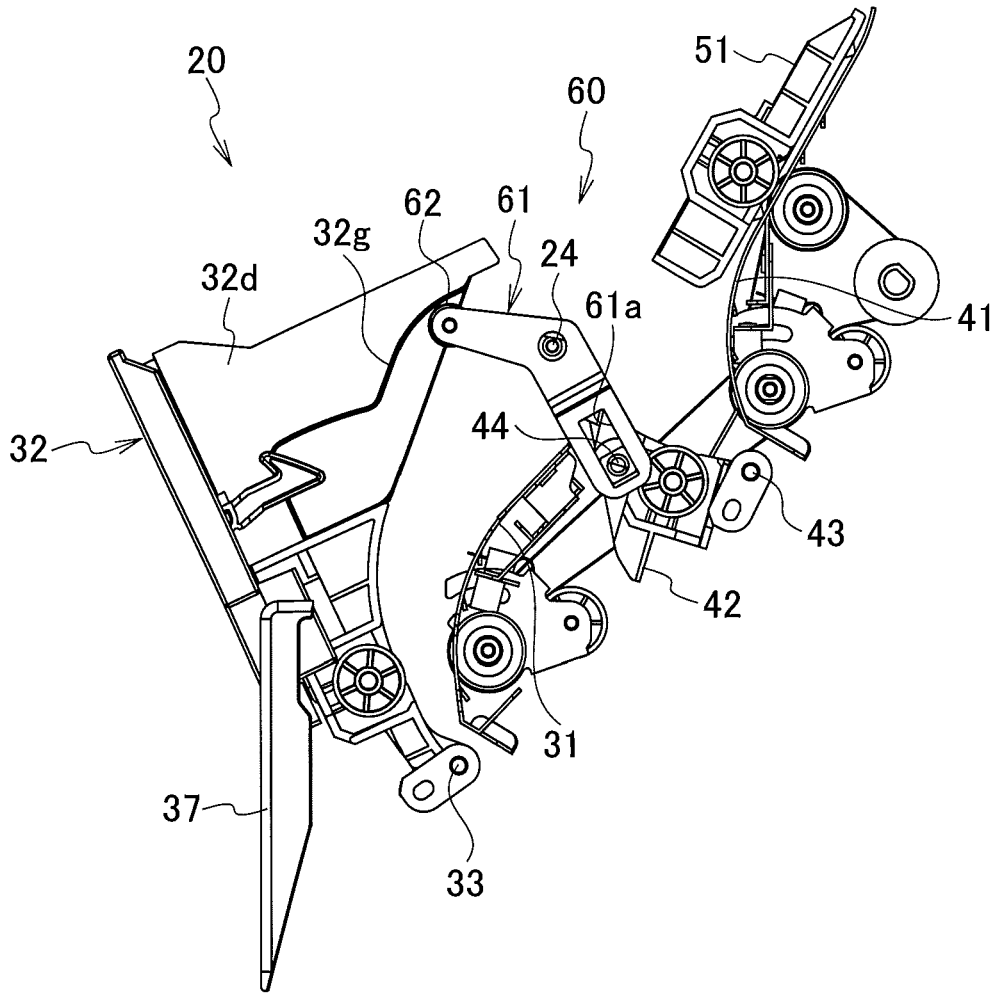
FIG. 12 is a side view showing a second operated state of the paper transfer guide.

Next, in the second operated state shown in FIG. 12, closing of the second paper guide plate 32 is started after the jammed paper JP is removed.

Namely, as shown in FIG. 12, when the user pushes the second paper guide plate 32 in its closing direction, the second paper guide plate 32 is rotated about the first rotational axis 33 in a clockwise direction. The cam follower 62 attached to the linkage member 61 of the cooperative mechanism 60 is contacted with the cam (the curved cam portion 32*g*) formed on the inner side plate 32*d* of the second paper guide plate 32, and then the linkage member 61 is rotated about the shaft 24 in a counter-clockwise direction due to the cam mechanism.

Along with the rotation of the linkage member 61, the fourth paper guide plate 42 that is linked with the linkage member 61 via the movable block 44 slidably held in the rectangular hole 61*a* is rotated about the second rotational axis 43 in a clockwise direction. As the linkage member 61 rotates, the movable block 44 slides in the rectangular hole 61*a*. Since FIG. 12 shows a state just after the cam follower 62 contacts with the cam (the curved cam portion 32*g*), the movable block 44 is still located at the lower right end of the rectangular hole 61*a*.

Figure 13:
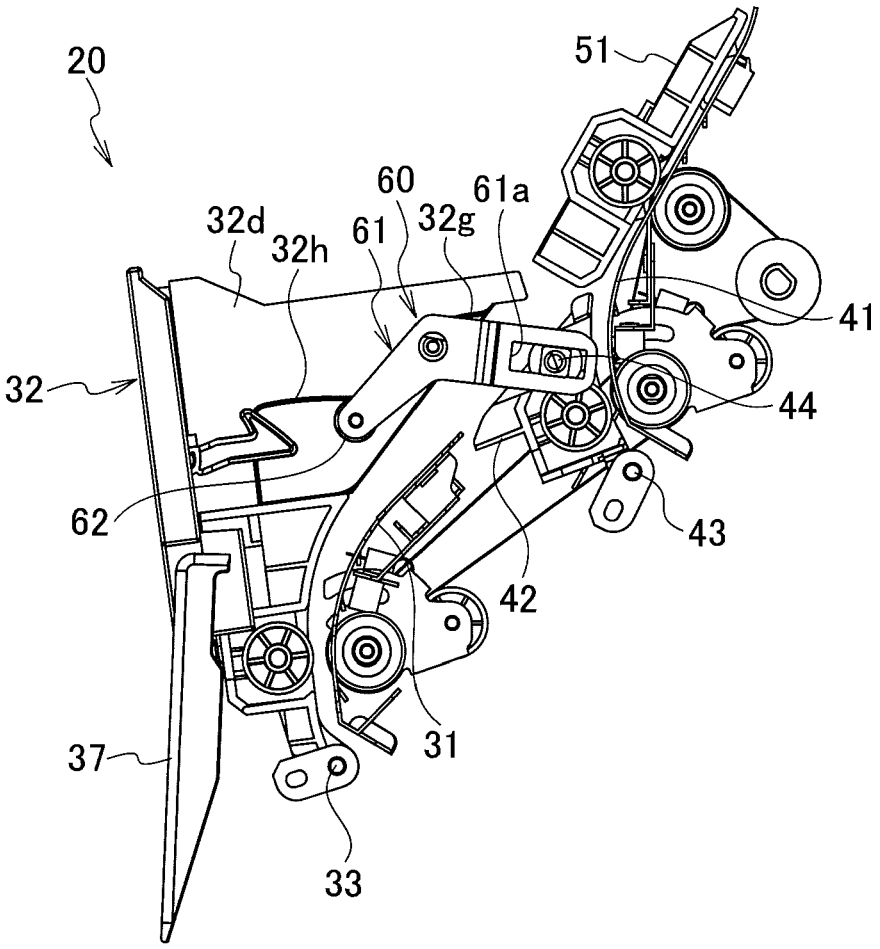
FIG. 13 is a side view showing a third operated state of the paper transfer guide.

In the third operated state shown in FIG. 13, the rotation of the fourth paper guide plate 42 is temporarily stopped while closing the second paper guide plate 32.

Namely, when the user further rotates the second paper guide plate 32 about the first rotational axis 33 in a clockwise direction from the second operated state shown in FIG. 12, the cam follower 62 attached to the linkage member 61 of the cooperative mechanism 60 moves downward along the curved cam portion 32*g* formed on the inner side plate 32*d* of the second paper guide plate 32, and then reaches the horizontal cam portion 32*h* continuously formed from the curved cam portion 32*g* as shown in FIG. 13.

While the cam follower 62 contacts with the horizontal cam portion 32*h*, the rotation of the fourth paper guide plate 42 that is linked with the linkage member 61 via the movable block 44 slidably held in the rectangular hole 61*a* is temporarily stopped. In this state, the movable block 44 is already moved leftward from the one end (a right end in FIG. 13) of the rectangular hole 61*a*.

Figure 14:
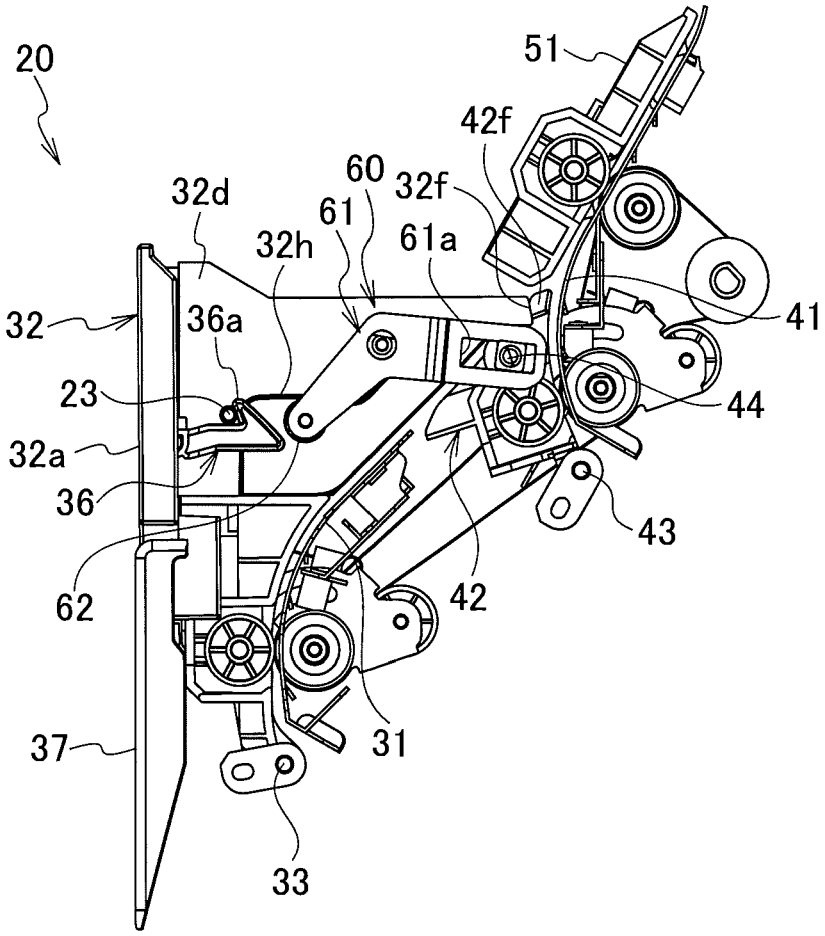
FIG. 14 is a side view showing a fourth operated state of the paper transfer guide.

In the fourth operated state shown in FIG. 14, the second paper guide plate 32 is closed, and the fourth paper guide plate 42 is about to be pushed in a close direction (rightward) by the second paper guide plate 32.

Namely, when the user further rotates the second paper guide plate 32 about the first rotational axis 33 in a clockwise direction from the third operated state shown in FIG. 13, the side cover 32*a* of the second paper guide plate 32 is oriented almost vertically as shown in FIG. 14.

During this operation, the cam follower 62 attached to the linkage member 61 of the cooperative mechanism 60 moves leftward along the horizontal cam portion 32*h* formed on the inner side plate 32*d* of the second paper guide plate 32, but the rotation of the fourth paper guide plate 42 is still stopped. Therefore, the movable block 44 is still located at almost the same position in the rectangular hole 61*a* as that in the third operated state shown in FIG. 13.

Therefore, the rotation of the linkage member 61 is also temporarily stopped while the cam follower 62 of the linkage member 61 contacts with the horizontal cam portion 32*h* of the second paper guide plate 32. Since the rotation of the linkage member 61 is temporarily stopped, the one end of the linkage member 61 at which the rectangular hole 61*a* is formed is never contacted with the communal paper guide plate 51 and the communal paper guide plate 51 that are fixedly provided.

When the pressing portions 32*f* formed at upper end portions of the inner side plates 32*d* and 32*e* of the second paper guide plate 32 contact with (start to press) the pressed portions 42*f* formed at upper end portions of the side plates 42*d* and 42*e* of the fourth paper guide plate 42, the hooks 36*a* of the engagement arms 36 are engaged with the engagement pins 23 provided on the inner surfaces of the front-side plate 21 and the rear-side plate 22 (FIG. 3). Since the rotation of the linkage member 61 is temporarily stopped, the engagement arms 36 and the engagement pins 23 can be engaged with each other easily and surely when engaging the second paper guide plate 32 with the frame FR (FIG. 3).

Figure 15:
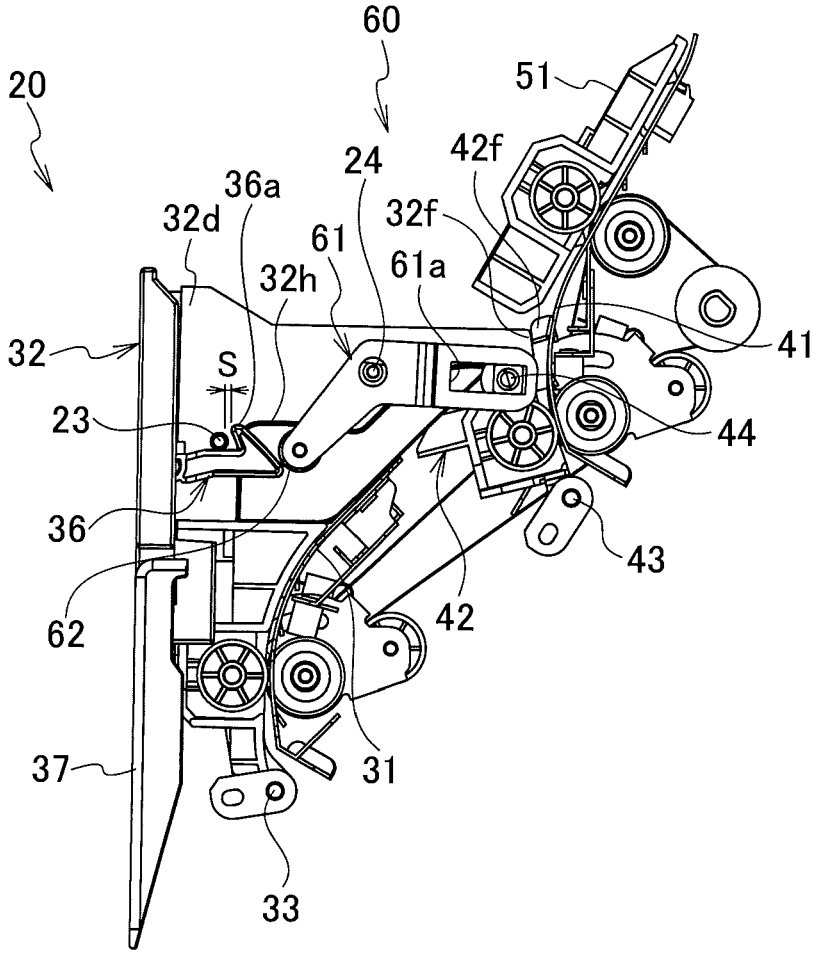
FIG. 15 is a side view showing a fifth operated state of the paper transfer guide.

In the fifth operated state shown in FIG. 15, the fourth paper guide plate 42 is further pushed in a close direction (rightward) by the second paper guide plate 32 while the second paper guide plate 32 is closed.

Namely, the user further rotates the second paper guide plate 32 about the first rotational axis 33 in a clockwise direction from the fourth operated state shown in FIG. 14, so that the pressing portions 32*f* formed on the second paper guide plate 32 further press (push) the pressed portions 42*f* formed on the fourth paper guide plate 42.

The fourth paper guide plate 42 is further rotated about the about the second rotational axis 43 in a clockwise direction. However, the discordancy between the rotating path of the linkage member 61 and the rotating path of the fourth paper guide plate 42 can be absorbed by the movement of the movable block 44 in the rectangular hole 61*a*. Therefore, the second paper guide plate 32 and the fourth paper guide plate 42 can be operated together with each other without any strain.

In addition, by further pushing of the second paper guide plate 32 toward the fourth paper guide plate 42, a gap is generated between the hook 36*a* of the engagement arm(s) 36 and the engagement pin 23 of the front-side plate 21 (the rear-side plate 22).

Further, the cam follower 62 of the linkage member 61 is still contacted with the horizontal cam portion 32*h* of the second paper guide plate 32.

Figure 16:
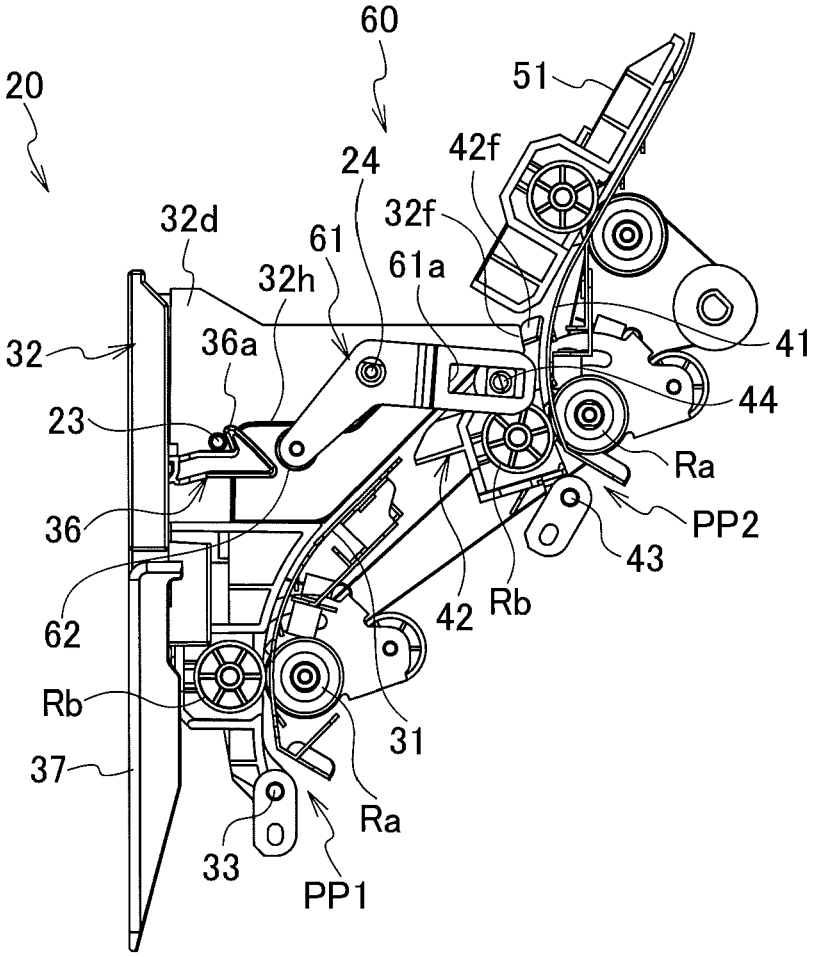
FIG. 16 is a side view showing a sixth operated state of the paper transfer guide.

In the sixth operated state shown in FIG. 16, the second paper guide plate 32 is completely closed.

Namely, the second paper guide plate 32 is pushed back leftward as shown in FIG. 16 due to reactive forces (elastic restoring forces) interacting between the drive rollers Ra and the driven rollers Rb after the fourth paper guide plate 42 is further pushed by the second paper guide plate 32 in the fifth operated state. Therefore, the pressed portions 42*f* formed on the fourth paper guide plate 42 follow the pressing portions 32*f* formed on the second paper guide plate 32.

Along with pushing back of the second paper guide plate 32, the gap S (FIG. 15) generated between the hook 36*a* of the engagement arm(s) 36 and the engagement pin 23 of the front-side plate 21 (the rear-side plate 22) is eliminated, and thereby the hook(s) 36*a* and the engagement pin(s) 23 are engaged firmly.

Further, the cam follower 62 of the linkage member 61 is still contacted with the horizontal cam portion 32*h* of the second paper guide plate 32, and the movable block 44 of the fourth paper guide plate 42 is held in the rectangular hole 61*a* of the linkage member 61 in a state where a movable margin of the movable block 44 is still left on its right side in the rectangular hole 61*a*.

Therefore, each gap of the first paper transfer path PP1 and the second paper transfer path PP2 is restored to its initial (default) value, so that the paper transfer guide 20 is restored to its initial state as shown in FIG. 5A.

(Modified Example of Paper Transfer Device)

Figure 17:
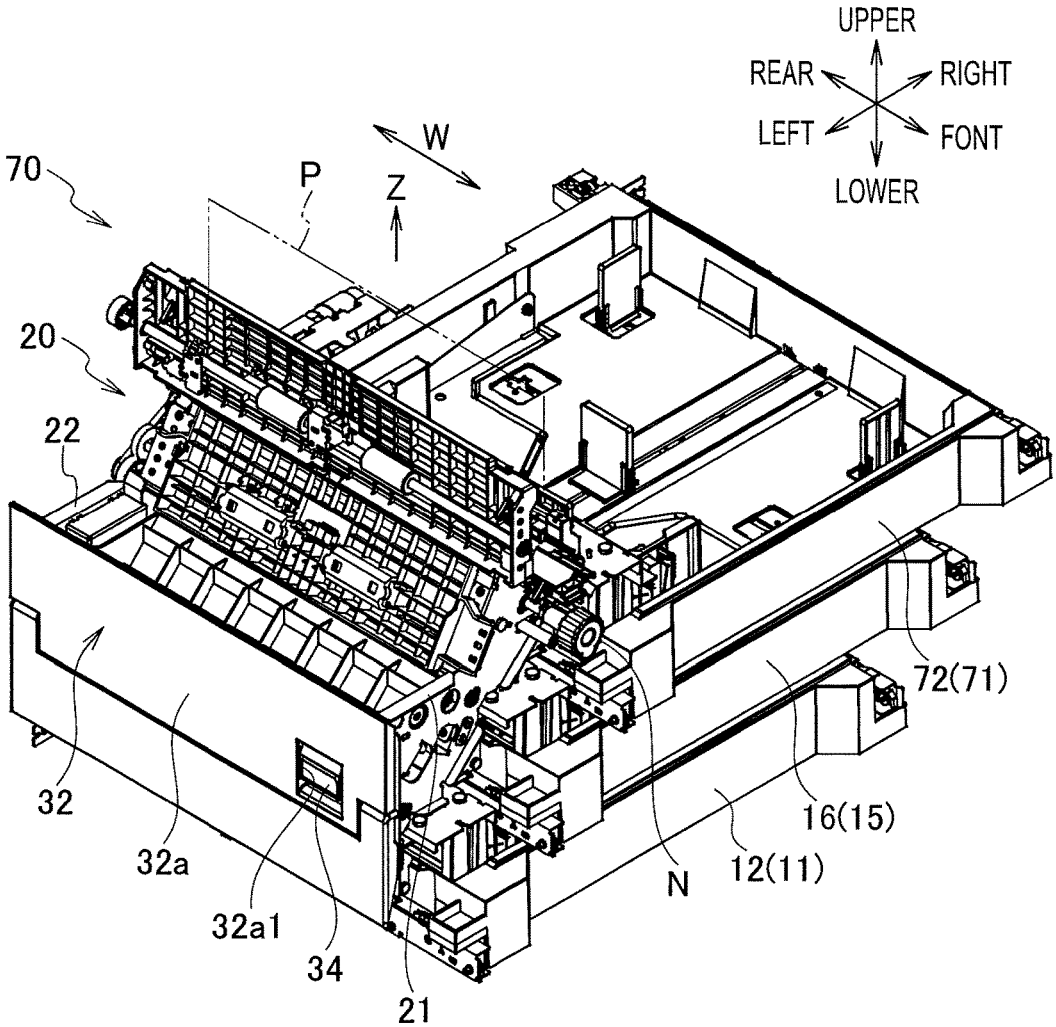
FIG. 17 is a modified example of the paper transfer guide according to the embodiment.
Figure 18:
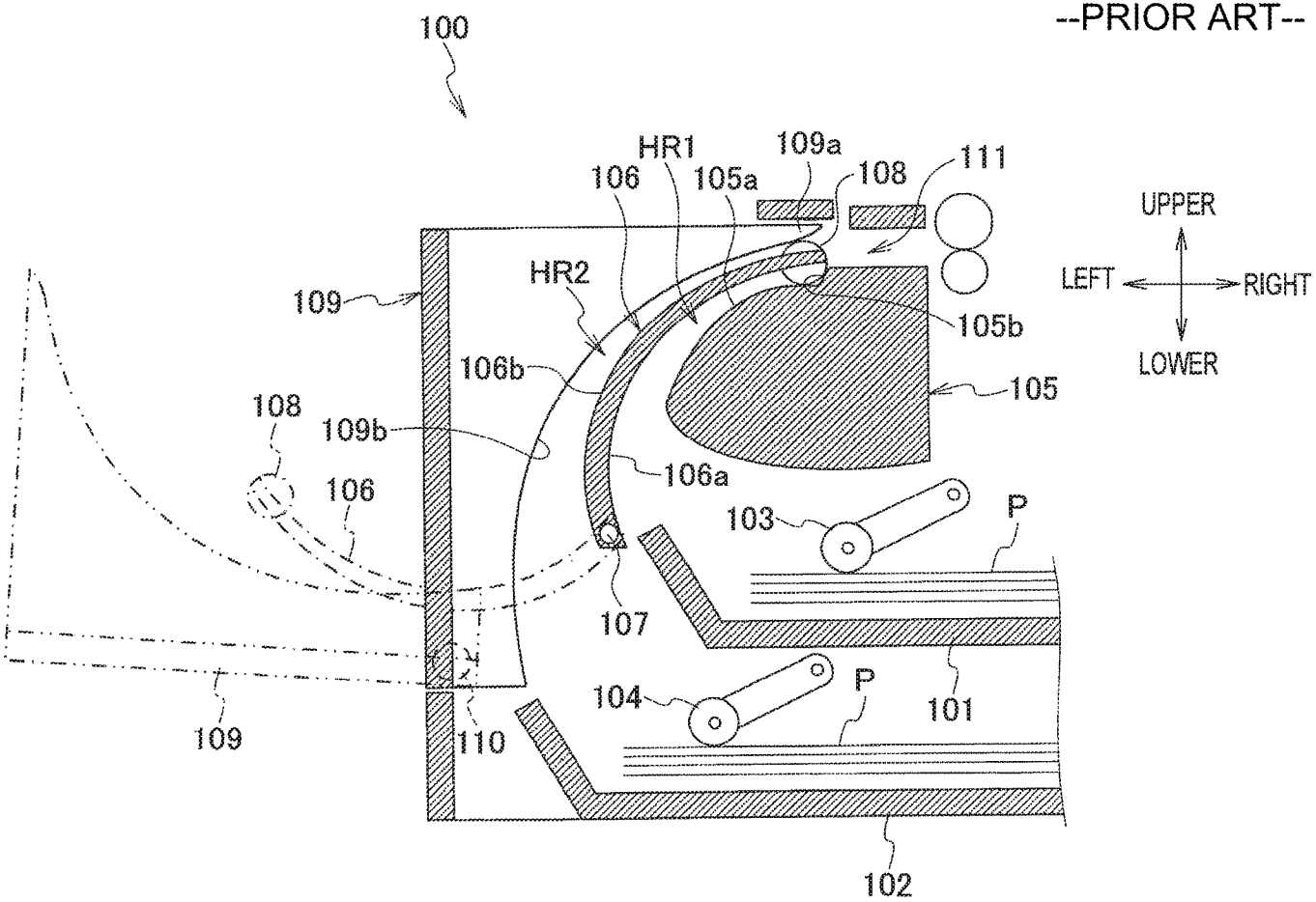
FIG. 18 is a cross-sectional view showing a prior-art sheet transfer device.

FIG. 17 shows a paper transfer device 70 that is made by partially modifying the paper transfer device 10 in the above-described embodiment.

The paper transfer device 70 is different from the paper transfer device 10 in the above-described embodiment only in that "three" paper feed trays are provided. Therefore, its descriptions will be made simply.

In the paper transfer device 70, the first paper feed tray 12 of the first paper feeder 11 is provided as a lower shelf at a lower portion of the housing 2 (FIG. 1), the second paper feed tray 16 of the second paper feeder 15 is provided as a middle shelf so as to be stacked over the first paper feed tray 12, and a third paper feed tray 72 of a third paper feeder 71 is provided as an upper shelf so as to be stacked over the second paper feed tray 16.

In addition, the leading end of the first paper feed tray 12 along the paper feed direction X is protruded leftward from the leading end of the second paper feed tray 16, and the leading end of the second paper feed tray 16 is protruded leftward from a leading end of the third paper feed tray 72. Therefore, the leading end of the first paper feed tray 12 is located at a most-leftward position.

Also in this modified example, the paper transfer guide 20 is disposed between the front-side plate 21 and the rear-side plate 22 that are provided so as to be associated with a front inner side and a rear inner side of the housing 2 (FIG. 1), respectively. Since the paper transfer guide 20 in this modified example is also associated with the first paper feed tray 12 of the first paper feeder 11 and the second paper feed tray 16 of the second paper feeder 15, the paper transfer guide 20 in this modified example is the same as the paper transfer guide 20 in the above embodiment that is described with reference to FIG. 5A to FIG. 5C.

However, a third paper transfer path (not shown) is additionally provided in association with the third paper feed tray 72 of the third paper feeder 71. Therefore, a jammed paper on the third paper transfer path is removed by using another paper transfer guide (not shown) that is provided independently from the paper transfer guide 20.

Therefore, the paper transfer device 10 in the above embodiment and the paper transfer device 70 in this modified example can be applied to a configuration provided with the first paper feed tray 12 and the second paper feed tray 16.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of a priority under 35 U.S.C. §119 to Japanese Patent Application No. 2014-240890, filed on Nov. 28, 2014, the entire content of which is incorporated herein by reference.

What is claimed is:

1. A paper transfer device comprising:

a first paper transfer feeder and a second paper transfer feeder that selectively feed a paper;

a first paper transfer path on which the paper fed from the first paper feeder is transferred;

a second paper transfer path on which the paper fed from the second paper feeder is transferred;

a communal paper transfer path that is disposed downstream from the first paper transfer path and the second paper transfer path and on which the paper transferred from the first paper transfer path or the second paper transfer path is transferred;

a first paper guide plate that is provided fixedly on the first paper transfer path;

a second paper guide plate that is provided rotatably so as to be opened and closed, and that, when being closed, faces the first paper guide plate with the first paper transfer path interposed therebetween;

a third paper guide plate that is provided fixedly on the second paper transfer path on an inner side from the first paper guide plate;

a fourth paper guide plate that is provided rotatably so as to be opened and closed, and that, when being closed, faces the third paper guide plate with the second paper transfer path interposed therebetween and faces the second paper guide plate; and a cooperative mechanism that opens the fourth paper guide plate synchronously with opening of the second paper guide plate, and closes the fourth paper guide plate synchronously with closing of the second paper guide plate.

2. The paper transfer device according to claim 1, wherein the cooperative mechanism includes, a cam that is disposed on the second paper guide plate, a coupling member that is attached to the fourth paper guide plate, and a rotatable linkage that is pivotally supported by a shaft provided between the second paper guide plate and the fourth paper guide plate, the coupling member is slidably disposed in an elongated hole formed at one end of the linkage, a cam follower that is contacted-with and separated-from the cam is provided at another end of the linkage, along with opening of the second paper guide plate, the cam follower is separated from the cam, and thereby the forth paper guide plate is opened via the linkage; and along with closing of the second paper guide plate, the cam follower is contacted with the cam, and thereby the forth paper guide plate is closed via the linkage.

3. The paper transfer device according to claim 2, wherein the second paper guide plate includes a pressing portion that is protruded toward the fourth paper guide plate, a curved cam and a horizontal cam that is formed continuously from the curved cam are formed as the cam, the fourth paper guide plate includes a pressed portion that is pressed by the pressing portion of the second paper guide plate, contact by the cam follower with the horizontal cam results in the closing of the fourth paper guide plate being temporarily stopped, but the fourth paper guide plate is fully closed when the pressing portions of the second paper guide plate presses the pressed portion of the fourth paper guide plate.

* * * * *